US011060039B2

(12) United States Patent
Heeter et al.

(10) Patent No.: US 11,060,039 B2
(45) **Date of Patent: *Jul. 13, 2021**

(54) PYROLYSIS TAR PRETREATMENT

(71) Applicant: ExxonMobil Chemical Patents Inc., Baytown, TX (US)

(72) Inventors: Glenn A. Heeter, The Woodlands, TX (US); Kapil Kandel, Humble, TX (US); Teng Xu, Houston, TX (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/467,776

(22) PCT Filed: Dec. 1, 2017

(86) PCT No.: PCT/US2017/064165

§ 371 (c)(1),
(2) Date: Jun. 7, 2019

(87) PCT Pub. No.: WO2018/111576

PCT Pub. Date: Jun. 21, 2018

(65) Prior Publication Data

US 2019/0367825 A1 Dec. 5, 2019

Related U.S. Application Data

(60) Provisional application No. 62/435,238, filed on Dec. 16, 2016.

(51) Int. Cl.
*C10G 45/72* (2006.01)
*C10G 1/02* (2006.01)
(Continued)

(52) U.S. Cl.
CPC ..... *C10G 45/72* (2013.01); *C10G 1/002* (2013.01); *C10G 1/02* (2013.01); *C10G 31/10* (2013.01);
(Continued)

(58) Field of Classification Search
None
See application file for complete search history.

(56) References Cited

U.S. PATENT DOCUMENTS 4,312,742 A 1/1982 Hayashi
5,871,634 A 2/1999 Wiehe et al.
(Continued)

FOREIGN PATENT DOCUMENTS

CN 106232778 12/2016
CN 106414673 2/2017
(Continued)

OTHER PUBLICATIONS

Process Pro Eric "Mitigating Hydroprocessing Reactor Fouling", Refiner Link, Jun. 16, 2014. (URL: http://www.refinerlink.com/blog/Mitigating_Hydroprocessing_Reactor_Fouling/).
(Continued)

*Primary Examiner* — Tam M Nguyen

(57) ABSTRACT

This invention relates to thermally-treating and hydroprocessing pyrolysis tar to produce a hydroprocessed pyrolysis tar, but without excessive foulant accumulation during the hydroprocessing. The invention also relates to upgrading the hydroprocessed tar by additional hydroprocessing; to products of such processing; to blends comprising one or more of such products; and to the use of such products and blends, e.g., as lubricants, fuels, and/or constituents thereof.

19 Claims, 3 Drawing Sheets

(51) Int. Cl.

| | |
|---|---|
| ***C10G 31/10*** | (2006.01) |
| ***C10G 1/00*** | (2006.01) |
| ***C10G 45/00*** | (2006.01) |
| ***C10G 69/06*** | (2006.01) |
| ***C10G 47/36*** | (2006.01) |
| ***C10G 75/00*** | (2006.01) |

(52) U.S. Cl.

CPC ..... *C10G 45/00* (2013.01); *C10G 47/36* (2013.01); *C10G 69/06* (2013.01); *C10G 75/00* (2013.01); *C10G 2300/1003* (2013.01); *C10G 2300/201* (2013.01); *C10G 2300/202* (2013.01); *C10G 2300/205* (2013.01); *C10G 2300/207* (2013.01); *C10G 2300/208* (2013.01); *C10G 2300/301* (2013.01); *C10G 2300/302* (2013.01); *C10G 2300/304* (2013.01); *C10G 2300/308* (2013.01); *C10G 2300/4006* (2013.01); *C10G 2300/4018* (2013.01)

(56) References Cited

U.S. PATENT DOCUMENTS

| | | | |
|---|---|---|---|
| 9,090,835 | B2 | 7/2015 | Beech, Jr. et al. |
| 9,090,836 | B2 | 7/2015 | Brown et al. |
| 9,102,884 | B2 | 8/2015 | Xu et al. |
| 9,580,523 | B2 | 2/2017 | Wong et al. |
| 9,637,694 | B2 | 5/2017 | Evans et al. |
| 9,657,239 | B2 | 5/2017 | Beech, Jr. et al. |
| 10,072,218 | B2 | 9/2018 | Chen et al. |
| 2010/0288679 | A1 | 11/2010 | Himelfarb |
| 2013/0081979 | A1 | 4/2013 | Brown et al. |
| 2014/0061094 | A1 | 3/2014 | Xu et al. |
| 2014/0061095 | A1 | 3/2014 | Beech, Jr. et al. |
| 2014/0061096 | A1 | 3/2014 | Brown et al. |
| 2014/0061100 | A1 | 3/2014 | Lattner et al. |
| 2014/0174980 | A1 | 6/2014 | Brown et al. |
| 2015/0122701 | A1 | 5/2015 | Shih et al. |
| 2015/0141717 | A1 | 5/2015 | Frey et al. |
| 2015/0315496 | A1 | 11/2015 | Soultanidis et al. |
| 2015/0344785 | A1 | 12/2015 | Soultanidis et al. |
| 2015/0344790 | A1 | 12/2015 | Ferrughelli et al. |
| 2015/0353851 | A1 | 12/2015 | Buchanan |
| 2015/0361354 | A1 | 12/2015 | Xu et al. |
| 2015/0361359 | A1 | 12/2015 | Beech, Jr. et al. |
| 2015/0368570 | A1 | 12/2015 | Beech, Jr. et al. |
| 2016/0122667 | A1 | 5/2016 | Evans et al. |
| 2016/0177205 | A1 | 6/2016 | Evans et al. |
| 2017/0002273 | A1 | 1/2017 | Rubin-Pitel et al. |
| 2019/0016969 | A1 | 1/2019 | Kandel et al. |
| 2019/0300803 | A1 | 10/2019 | Emanuele et al. |
| 2019/0367822 | A1 | 12/2019 | Kandel et al. |
| 2019/0367825 | A1 | 12/2019 | Heeter et al. |
| 2020/0063046 | A1 | 2/2020 | Kandel et al. |
| 2020/0071627 | A1 | 3/2020 | Xu et al. |

FOREIGN PATENT DOCUMENTS

| | | | |
|---|---|---|---|
| WO | 2013/033580 | A | 3/2013 |
| WO | 2013/033582 | A | 3/2013 |
| WO | 2013/033590 | A | 3/2013 |
| WO | 2015/191236 | A | 12/2015 |

OTHER PUBLICATIONS

U.S. Appl. No. 62/380,538, filed Aug. 29, 2016.

PYROLYSIS TAR PRETREATMENT

CROSS-REFERENCE OF RELATED APPLICATIONS

PRIORITY CLAIM

This application is a National Phase Application claiming priority to P.C.T. Patent Application Ser. No. PCT/US2017/064165, filed Dec. 01, 2017, which claims priority to and the benefit of U.S. Patent Application Ser. No. 62/435,238, filed Dec. 16, 2016, which are incorporated by reference in their entireties.

RELATED APPLICATIONS

This application is related to the following applications: U.S. patent application Ser. No. 15/829,034, filed Dec. 1, 2017; U.S. Patent Application Ser. No. 62/525,345, filed Jun. 27, 2017; PCT Patent Application No. PCT/US2017/064117, filed Dec. 1, 2017; U.S. Patent Application Ser. No. 62/561,478, filed Sep. 21, 2017; PCT Patent Application No. PCT/US2017/064128, filed Dec. 1, 2017; U.S. Patent Application Ser. No. 62/571,829, filed Oct. 13, 2017; PCT Patent Application No. PCT/US2017/064140, filed Dec. 1, 2017; PCT Patent Application No. PCT/US2017/064176, filed Dec. 1, 2017, which are incorporated by reference in their entireties.

FIELD

This invention relates to thermally-treating and hydroprocessing pyrolysis tar to produce a hydroprocessed pyrolysis tar, but without excessive foulant accumulation during the hydroprocessing. The invention also relates to upgrading the hydroprocessed tar by additional hydroprocessing; to products of such processing, e.g., the thermally-treated tar, the hydroprocessed tar, and the upgraded hydroprocessed tar; to blends comprising one or more of such products; and to the use of such products and blends, e.g., as lubricants, fuels, and/or constituents thereof.

BACKGROUND

Pyrolysis processes, such as steam cracking, are utilized for converting saturated hydrocarbons to higher-value products such as light olefins, e.g., ethylene and propylene. Besides these useful products, hydrocarbon pyrolysis can also produce a significant amount of relatively low-value heavy products, such as pyrolysis tar. When the pyrolysis is conducted by steam cracking, the pyrolysis tar is identified as steam-cracker tar ("SCT"). Pyrolysis tar is a high-boiling, viscous, reactive material comprising complex, ringed and branched molecules that can polymerize and foul equipment. Pyrolysis tar also contains high molecular weight non-volatile components including paraffin insoluble compounds, such as pentane insoluble compounds and heptane-insoluble compounds. Particularly challenging pyrolysis tars contain >1 wt. % toluene insoluble compounds. The toluene insoluble components are high molecular weight compounds, typically multi-ring structures that are also referred to as tar heavies ("TH"). These high molecular weight molecules can be generated during the pyrolysis process, and their high molecular weight leads to high viscosity, which makes the tar difficult to process and transport.

Blending pyrolysis tar with lower viscosity hydrocarbons has been proposed for improved processing and transport of pyrolysis tar. However, when blending heavy hydrocarbons, fouling of processing and transport facilities can occur as a result of precipitation of high molecular weight molecules, such as asphaltenes. See, e.g., U.S. Pat. No. 5,871,634, which is incorporated herein by reference in its entirety. In order to mitigate asphaltene precipitation, an Insolubility Number, $I_N$, and a Solvent Blend Number, $S_{BN}$, (determined for each blend component) can be used to guide the blending process. Successful blending is accomplished with little or substantially no precipitation by combining the components in order of decreasing $S_{BN}$, so that the $S_{BN}$ of the blend is greater than the $I_N$ of any component of the blend. Pyrolysis tars generally have high $S_{BN}$ >135 and high $I_N$ >80 making them difficult to blend with other heavy hydrocarbons. Pyrolysis tars having $I_N$ >100, e.g., >110, e.g., >130, are particularly difficult to blend without phase separation occurring.

Pyrolysis tar hydroprocessing has been proposed to reduce viscosity and improve both $I_N$ and $S_{BN}$, but challenges remain, primarily resulting from fouling of process equipment. For example, hydroprocessing of neat SCT results in rapid catalyst deactivation when the hydroprocessing is carried out at a temperature in the range of about 250° C. to 380° C., a pressure in the range of about 5400 kPa to 20,500 kPa, using a conventional hydroprocessing catalyst containing one or more of Co, Ni, or Mo. This deactivation has been attributed to the presence of TH in the SCT, which leads to the formation of undesirable deposits (e.g., coke deposits) on the hydroprocessing catalyst and the reactor internals. As the amount of these deposits increases, the yield of the desired upgraded pyrolysis tar (e.g., upgraded SCT) decreases and the yield of undesirable byproducts increases. The hydroprocessing reactor pressure drop also increases, often to a point where the reactor becomes inoperable before a desired reactor run length can be achieved.

To overcome these difficulties, International Patent Application Publication No. WO 2013/033580 discloses hydroprocessing SCT in the presence of a utility fluid comprising a significant amount of single and multi-ring aromatics to form an upgraded pyrolysis tar product. That publication, which is incorporated by reference herein in its entirety, discloses that upgraded pyrolysis tar product generally has a decreased viscosity, decreased atmospheric boiling point range, and increased hydrogen content over that of the pyrolysis tar component of the hydroprocessor feed, resulting in improved compatibility with fuel oil and other common blend-stocks. Additionally, efficiency advances involving recycling a portion of the upgraded pyrolysis tar product as utility fluid are described in International Publication No. WO 2013/033590 which is also incorporated herein by reference in its entirety.

U.S. Patent Application Publication No. 2015/0315496, also incorporated herein by reference in its entirety, discloses separating and recycling a mid-cut utility fluid from the upgraded pyrolysis tar product. The utility fluid comprises ≥10.0 wt. % aromatic and non-aromatic ring compounds and each of the following: (a) ≥1.0 wt. % of 1.0 ring class compounds; (b) ≥5.0 wt. % of 1.5 ring class compounds; (c) ≥5.0 wt. % of 2.0 ring class compounds; and (d) ≥0.1 wt. % of 5.0 ring class compounds. Improved utility fluids are also disclosed in the following patent applications, each of which is incorporated by references in its entirety. U.S. Patent Application Publication No. 2015/0368570 discloses separating and recycling a utility fluid from the upgraded pyrolysis tar product. The utility fluid contains 1-ring and/or 2-ring aromatics and has a final boiling point ≤430° C. U.S. Patent Application Publication No. 2016/

0122667 discloses utility fluid which contains 2-ring and/or 3-ring aromatics and has solubility blending number ($S_{BN}$) ≥120.

Despite these advances, there remains a need for further improvements in the production of hydroprocessed pyrolysis tar, particularly processes which exhibit decreased reactor fouling to achieve appreciable hydroprocessing reactor run lengths.

SUMMARY

It has been discovered that a feed mixture comprising a pyrolysis tar having a pyrolysis tar reactivity ("$R_T$", expressed in units of Bromine Number, "BN") can be hydroprocessed for an appreciable reactor run length without undue reactor fouling, provided the feed mixture has a reactivity ("$R_F$", also expressed in BN) that does not exceed 12 BN. It has also been found that for a broad range of pyrolysis tars covering a very wide range of $R_T$, a pretreatment can be carried out to produce a pyrolysis tar+utility fluid mixture (a "tar-fluid mixture") having an $R_F$≤12 BN. The tar-fluid mixture can then be hydroprocessed under more severe conditions without appreciable reactor fouling. The pretreatment includes thermally treating the pyrolysis tar to produce a pyrolysis tar composition, combining the pyrolysis tar composition with a utility fluid comprising hydrocarbon to produce the tar-fluid mixture, and hydroprocessing the tar-fluid mixture under relatively mild hydroproces sing conditions identified as Pretreatment Hydroproces sing Conditions, including a pretreatment temperature ("$T_{PT}$"). Effluent from the pretreatment reactor (the "pretreater"), comprising a mixture of pretreated pyrolysis tar and utility fluid, can then be subjected to additional hydroprocessing in pyrolysis tar hydroprocessing reactors located downstream of the pretreatment reactor.

The pretreatment hydroprocessing is carried out using a pyrolysis tar feed that has been exposed to little (e.g., guard bed) or no prior hydroprocessing. As a result, the pretreatment reactor can exhibit an increase in pressure drop, e.g., from foulant accumulation. It is observed that under certain conditions, using certain pyrolysis tar feeds, the pressure drop increase results in a significantly shorter run length in for the pretreatment reactor than achieved in the pyrolysis tar hydroprocessing reactors located further downstream. In order to achieve run lengths in the pretreatment reactor of a duration comparable to that achieved in those downstream hydroprocessing reactors, the pretreatment reactor is periodically taken off-line and exposed to regeneration conditions. Operating under the specified regeneration conditions results in a sufficient decrease in the pretreatment reactor's pressure drop for the pretreatment reactor to be brought back on-line for continued pyrolysis tar pretreatment. The regeneration is carried out in the presence of molecular hydrogen, under regeneration conditions which include a temperature "$T_{Reg}$" ≥$T_{PT}$, a total pressure ≥3.5 MPa, and a molecular hydrogen space velocity (GHSV) ≤750 $hr^{-1}$.

Accordingly, certain aspects of the invention relate to a process for converting a pyrolysis tar. The pyrolysis tar has a reactivity ($R_T$) >28 BN, and at least 70 wt. % of the pyrolysis tar's components have a normal boiling point of at least 290° C., based on the total weight of the pyrolysis tar. The process includes thermally treating the pyrolysis tar by maintaining the pyrolysis tar within a temperature range of from $T_1$ to $T_2$ for a time ($t_{HS}$) sufficient to produce a pyrolysis tar composition having an Insolubles Content (IC) ≤6 wt. %. $T_1$ is ≥150° C., $T_2$ is ≤320° C., and $t_{HS}$ is ≥1 minute. The pyrolysis tar composition is combined with a utility fluid comprising hydrocarbon to produce a tar-fluid mixture having an $R_M$ ≤18. At least a portion of the tar-fluid mixture is hydroprocessed under Pretreatment Hydroprocessing Conditions to produce a pretreater effluent comprising a vapor portion and a liquid portion. The liquid portion comprises a pretreated tar-fluid mixture having an ($R_F$) ≤12 BN, wherein the pretreated tar-fluid mixture includes a pretreated pyrolysis tar. The Pretreatment Hydroprocessing Conditions include a temperature ($T_{PT}$) ≤400° C.; a space velocity ($WHSV_{PT}$) ≥0.3 $hr^{-1}$, based on the weight of the hydroprocessed portion of the tar-fluid mixture; a total pressure ($P_{PT}$) ≥8 MPa; an initial pressure drop ($\Delta P_1$) at time $t_1$, where $t_1$ is the time at the start of the Pretreatment Hydroprocessing Conditions; and a molecular hydrogen supply rate <3000 standard cubic feet per barrel of the hydroprocessed portion of the tar-fluid mixture (SCF/B) (534 S $m^3/m^3$). The pretreatment is carried out until the pretreatment reactor achieves a $\Delta P_2$ that is the lesser of (i) $F*\Delta P_1$, where F is a factor in the range of from 1.5 to 20 or (ii) a threshold pressure drop ≥2 psi (14 kPa). The regeneration is carried out under regeneration conditions which include a $T_{Reg}$≥$T_{PT}$, a total pressure ≥3.5 MPa, and a molecular hydrogen space velocity (GHSV) ≤750 $hr^{-1}$. The pretreatment reactor's ΔP decreases during regeneration, and the regeneration is carried out until the pretreatment reactor achieves a ΔP that is suitable for continued pretreatment mode operation.

BRIEF DESCRIPTION OF THE DRAWINGS

The drawings are for illustrative purposes only and are not intended to limit the scope of the present invention.

DETAILED DESCRIPTION

Figure 1:
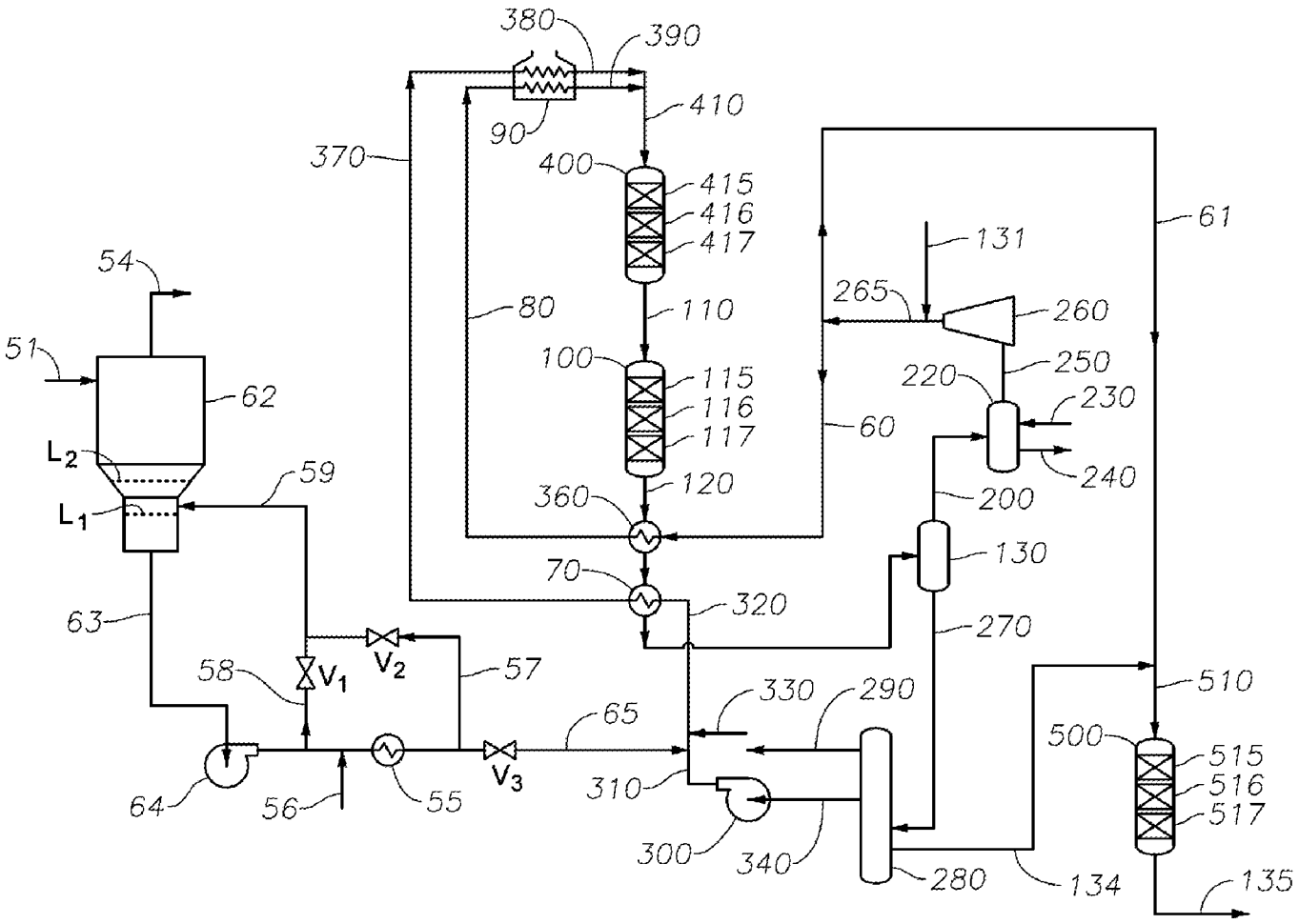
FIG. 1 is a schematic representation of certain aspects of the invention.

It has been found that foulant accumulation gradually occurs in the pretreatment reactor during pretreatment mode operation, which in turn increases reactor pressure drop ΔP. The problem is worsened by operating the pretreatment reactor in pretreatment mode for prolonged pretreatment time. It also has been found that at least a portion of the accumulated foulant can be removed, and ΔP decreased, by operating the pretreatment reactor in regeneration mode for the specified regeneration time under the specified regeneration conditions. Advantageously, the regeneration time is typically much less than the pretreatment time, which typically lessens the need for a second pretreatment reactor operating in parallel in pretreatment mode while the first pretreatment reactor operates in regeneration mode. The invention will now be described in more detail with reference to the following terms, which are defined for the purpose of this description and appended claims.

Definitions

The term "pyrolysis tar" means (a) a mixture of hydrocarbons having one or more aromatic components and optionally (b) non-aromatic and/or non-hydrocarbon molecules, the mixture being derived from hydrocarbon pyrolysis, with at least 70% of the mixture having a boiling point at atmospheric pressure that is ≥ about 550° F. (290° C.). Certain pyrolysis tars have an initial boiling point ≥200° C. For certain pyrolysis tars, ≥90.0 wt. % of the pyrolysis tar has a boiling point at atmospheric pressure ≥550° F. (290° C.). Pyrolysis tar can comprise, e.g., ≥50.0 wt. %, e.g., ≥75.0 wt. %, such as ≥90.0 wt. %, based on the weight of the pyrolysis tar, of hydrocarbon molecules (including mixtures and aggregates thereof) having (i) one or more aromatic components and (ii) a number of carbon atoms ≥ about 15. Pyrolysis tar generally has a metals content, $\leq 1.0\times10^3$ ppmw, based on the weight of the pyrolysis tar, which is an amount of metals that is far less than that found in crude oil (or crude oil components) of the same average viscosity. "SCT" means pyrolysis tar obtained from steam cracking.

"Aliphatic olefin component" or "aliphatic olefin content" means the portion of the tar that contains hydrocarbon molecules having olefinic unsaturation (at least one unsaturated carbon that is not an aromatic unsaturation) where the hydrocarbon may or may not also have aromatic unsaturation. For instance, a vinyl hydrocarbon like styrene, if present in the pyrolysis tar, would be included aliphatic olefin content. Pyrolysis tar reactivity has been found to correlate strongly with the pyrolysis tar's aliphatic olefin content. Although it is typical to determine reactivity ("$R_M$") of a tar-fluid mixture comprising a thermally-treated pyrolysis tar composition of reactivity $R_C$, it is within the scope of the invention to determine reactivity of the pyrolysis tar ($R_T$ and/or $R_M$) itself. Utility fluids generally have a reactivity $R_U$ that is much less than pyrolysis tar reactivity. Accordingly, $R_C$ of a pyrolysis tar composition can be derived from $R_M$ of a tar-fluid mixture comprising the pyrolysis tar composition, and vice versa, using the relationship $R_M$~[$R_C$*(weight of tar)+$R_U$*(weight of utility fluid)]/(weight of tar+weight of utility fluid). For instance, if a utility fluid having $R_U$ of 3 BN, and the utility fluid is 40% by weight of the tar-fluid mixture, and if $R_C$ (the reactivity of the neat pyrolysis tar composition) is 18 BN, then $R_M$ is approximately 12 BN.

"Tar Heavies" (TH) are a product of hydrocarbon pyrolysis having an atmospheric boiling point ≥565° C. and comprising ≥5.0 wt. % of molecules having a plurality of aromatic cores based on the weight of the product. The TH are typically solid at 25° C. and generally include the fraction of SCT that is not soluble in a 5:1 (vol:vol) ratio of n-pentane:SCT at 25° C. TH generally includes asphaltenes and other high molecular weight molecules.

Insolubles Content ("IC") means the amount in wt. % of components of a hydrocarbon-containing composition that are insoluble in a mixture of 25% by volume heptane and 75% by volume toluene. The hydrocarbon-containing composition can be an asphaltene-containing composition, e.g., one or more of pyrolysis tar; thermally-treated pyrolysis tar; hydroprocessed pyrolysis tar; and mixtures comprising a first hydrocarbon-containing component and a second component which includes one or more of pyrolysis tar, thermally-treated pyrolysis tar, and hydroprocessed pyrolysis tar. IC is determined as follows. First, the composition's asphaltene content is estimated, e.g., using conventional methods. Next, a mixture is produced by adding a test portion of the heptane-toluene mixture to a flask containing a test portion of the pyrolysis tar of weight $W_1$. The test portion of the heptane-toluene mixture is added to the test portion of the heptane-toluene mixture at ambient conditions of 25° C. and 1 bar (absolute) pressure. The following table indicates the test portion amount ($W_1$, in grams), the heptane-toluene mixture amount (in mL), and the Flask volume (in mL) as a function of the composition's estimated asphaltene content.

TABLE 1

Test Portion Size, Flask, and Heptane Volumes

| Estimated Asphaltene Content % m/m | Test Portion Size g | Flask Volume mL | Heptane Volume mL |
|---|---|---|---|
| Less than 0.5 | 10 ± 2 | 1000 | 300 ± 60 |
| 0.5 to 2.0 | 8 ± 2 | 500 | 240 ± 60 |
| Over 2.0 to 5.0 | 4 ± 1 | 250 | 120 ± 30 |
| Over 5.0 to 10.0 | 2 ± 1 | 150 | 60 ± 15 |
| Over 10.00 to 25.0 | 0.8 ± 0.2 | 100 | 25 to 30 |
| Over 25.0 | 0.5 ± 0.2 | 100 | 25 ± 1 |

While maintaining the ambient conditions, the flask is capped, and the heptane-toluene mixture is mixed with the indicated amount of the composition in the flask until substantially all of the composting has dissolved. The contents of the capped flask are allowed to rest for at least 12 hours. Next, the rested contents of the flask are decanted through a filter paper of 2 μm pore size and weight $W_2$ positioned within a Buchner funnel. The filter paper is washed with fresh heptane-toluene mixture (25:vol:vol), and the filter paper is dried. The dried filter paper is heated in an oven, and the heated filter paper is maintained at a temperature substantially equal to 60° C. for a time period in the range of from 10 minutes to 30 minutes. After this time period, the filter paper is cooled. After cooling, weight $W_3$ of the cooled filter paper is recorded. IC is determined from the equation $IC=(W_3-W_2)/W_1$. It is particularly desired for fuel oils, and even more particularly for transportation fuel oils such as marine fuel oils, to have an IC that is ≤6 wt. %, e.g., ≤5 wt. %, such as ≤4 wt. %, or ≤3 wt. %, or ≤2 wt. %, or ≤1 wt. %.

"Intermediate Hydroprocessing Conditions" include a temperature ("$T_I$") ≥200° C.; a total pressure ("$P_I$") ≥3.5 MPa, e.g., ≥6 MPa; a weight hourly space velocity ("$WHSV_I$") ≥0.3 $hr^{+1}$, based on the weight the pretreated tar-fluid mixture subjected to the intermediate hydroprocessing; and a total amount of molecular hydrogen supplied to a hydroprocessing stage operating under Intermediate Hydroprocessing Conditions ≥1000 standard cubic feet per barrel of pretreated tar-fluid mixture subjected to intermediate hydroproces sing (178 S $m^3/m^3$). Conditions can be selected within the Intermediate Hydroprocessing Conditions to achieve a 566° C.+ conversion, of ≥20 wt. % substantially continuously for at least ten days at a molecular hydrogen consumption rate in the range of from 2200 standard cubic feet per barrel of tar in the pretreater effluent (SCF/B) (392 S $m^3/m^3$) to 3200 SCF/B (570 S $m^3/m^3$).

At least one stage of pretreatment hydroprocessing under "Pretreatment Hydroprocessing Conditions" is carried out before a stage of hydroprocessing under Intermediate Hydroprocessing Conditions. Pretreatment Hydroprocessing Conditions include a temperature $T_{PT}$ ≤400° C., a space velocity ($WHSV_{PT}$) ≥0.3 $hr^{-1}$ based on the weight of the tar-fluid mixture, a total pressure ("$P_{PT}$") ≥3.5 MPa, e.g., ≥6 MPa, and supplying the molecular hydrogen at a rate <3000 standard cubic feet per barrel of the tar-fluid mixture (SCF/B) (534 S $m^3/m^3$).

Pretreatment Hydroprocessing Conditions are less severe than Intermediate Hydroprocessing Conditions. For example, compared to Intermediate Hydroprocessing Conditions, Pretreatment Hydroprocessing Conditions utilize one or more of a lesser hydroprocessing temperature, a lesser hydroprocessing pressure, a greater feed (tar+utility fluid) WHSV, a greater pyrolysis tar WHSV, and a lesser molecular hydrogen consumption rate. Within the parameter ranges (T, P, WHSV, etc.) specified for Pretreater Hydroprocessing Conditions, particular hydroprocessing conditions can be selected to achieve a desired 566° C.+ conversion, typically in the range of from 0.5 wt. % to 5 wt. % substantially continuously for at least ten days. Although operating the pretreatment hydroprocessing at an appreciably greater total pressure than the intermediate hydroprocessing is within the scope of the invention, this is not required.

Optionally, at least one stage of retreatment hydroprocessing under Retreatment Hydroprocessing Conditions is carried out after a stage of hydroprocessing under Intermediate Hydroprocessing Conditions. Typically, the retreatment hydroprocessing is carried out with little or no utility fluid. "Retreatment Hydroprocessing Conditions", which are typically more severe than the Intermediate Hydroprocessing Conditions, include a temperature ($T_R$) ≥360° C.; a space velocity ($WHSV_R$) ≤0.6 $hr^{-1}$, based on the weight of hydroprocessed tar subjected to the retreatment; a molecular hydrogen supply rate ≥2500 standard cubic feet per barrel of hydroprocessed tar (SCF/B) (445 S $m^3/m^3$); a total pressure ("$P_R$") ≥3.5 MPa, e.g., ≥6 MPa; and $WHSV_R \leq WHSV_I$.

When a temperature is indicated for particular catalytic hydroprocessing conditions in a hydroprocessing zone, e.g., Pretreatment, Intermediate, and Retreatment Hydroprocessing Conditions, this refers to the average temperature of the hydroprocessing zone's catalyst bed (one half the difference between the bed's inlet and outlet temperatures). When the hydroprocessing reactor contains more than one hydroprocessing zone (e.g., as shown in FIG. 1) the hydroprocessing temperature is the average temperature in the hydroprocessing reactor (e.g., one half the difference between the temperature of the most upstream catalyst bed's inlet and the temperature of the most downstream catalyst bed's outlet temperature).

Total pressure in each of the hydroprocessing stages is typically regulated to maintain a flow of pyrolysis tar, pyrolysis tar composition, pretreated tar, hydroprocessed tar, and retreated tar from one hydroprocessing stage to the next, e.g., with little or need for inter-stage pumping. Although it is within the scope of the invention for any of the hydroprocessing stages to operate at an appreciably greater pressure than others, e.g., to increase hydrogenation of any thermally-cracked molecules, this is not required. The invention can be carried out using a sequence of total pressure from stage-to-stage that is sufficient (i) to achieve the desired amount of tar hydroprocessing; (ii) to overcome any pressure drops across the stages; and (iii) to maintain tar flow to the process, from stage-to-stage within the process, and away from the process.

Reactivities such as pyrolysis tar reactivity $R_T$, pyrolysis tar composition reactivity $R_C$, and the reactivity $R_M$ of the tar-fluid mixture have been found to be well-correlated with the tar's aliphatic olefin content, especially the content of styrenic hydrocarbons and dienes. While not wishing to be bound by any particular theory, it is believed that the pyrolysis tar's aliphatic olefin compounds (i.e., the tar's aliphatic olefin components) have a tendency to polymerize during hydroprocessing. The polymerization leads to the formation of coke precursors, which can plug or otherwise foul the reactor. Fouling is more prevalent in the absence of hydrogenation catalysts, such as in the preheater and dead volume zones of a hydroprocessing reactor. Since a pyrolysis tar's aliphatic olefin content expressed in BN is particularly well-correlated with the tar's reactivity, $R_T$, $R_C$, and $R_M$ can be expressed in BN units, i.e., the amount of bromine (as $Br_2$) in grams consumed (e.g., by reaction and/or sorption) by 100 grams of a pyrolysis tar sample. Bromine Index ("BI") can be used instead of or in addition to BN measurements, where BI is the amount of $Br_2$ mass in mg consumed by 100 grams of pyrolysis tar.

Pyrolysis tar reactivity can be measured using a sample of the pyrolysis tar withdrawn from a pyrolysis tar source, e.g., bottoms of a flash drum separator, a tar storage tank, etc. The sample is combined with sufficient utility fluid to achieve a predetermined 50° C. kinematic viscosity in the tar-fluid mixture, typically ≤500 cSt. Although the BN measurement can be carried out with the tar-fluid mixture at an elevated temperature, it is typical to cool the tar-fluid mixture to a temperature of about 25° C. before carrying out the BN measurement. Conventional methods for measuring BN of a heavy hydrocarbon can be used for determining pyrolysis tar reactivity, or that of a tar-fluid mixture, but the invention is not limited thereto. For example, BN of a tar-fluid mixture can be determined by extrapolation from conventional BN methods as applied to light hydrocarbon streams, such as electrochemical titration, e.g., as specified in A.S.T.M. D-1159; colorimetric titration, as specified in A.S.T.M. D-1158; and coulometric Karl Fischer titration. Typically, the titration is carried out on a tar sample having a temperature ≤ambient temperature, e.g., ≤25° C. Although the cited A.S.T.M. standards are indicated for samples of lesser boiling point, it has been found that they are also applicable to measuring pyrolysis tar BN. Suitable methods for doing so are disclosed by D. J. Ruzicka and K. Vadum in Modified Method Measures Bromine Number of Heavy Fuel Oils, Oil and Gas Journal, Aug. 3, 1987, 48-50; which is incorporated by reference herein in its entirety. Iodine number measurement (using, e.g., A.S.T.M. D4607 method, WIJS Method, or the Hübl method) can be used as an alternative to BN for determining pyrolysis tar reactivity. BN may be approximated from Iodine Number by the formula:

$$BN \sim \text{Iodine Number} * (\text{Atomic Weight of } I_2)/(\text{Atomic Weight of } Br_2).$$

Certain aspects of the invention include thermally-treating a pyrolysis tar, combining the thermally treated tar with utility fluid to produce a tar-fluid mixture, hydroprocessing the tar-fluid mixture under Pretreatment Hydroprocessing Conditions to produce a pretreater effluent, and hydroprocessing at least part of the pretreatment effluent under Intermediate Hydroprocessing Conditions to produce a hydroprocessor effluent comprising hydroprocessed tar. Representative pyrolysis tars will now be described in more detail. The invention is not limited to these pyrolysis tars, and this description is not meant to foreclose other pyrolysis tars within the broader scope of the invention.

Pyrolysis Tar

Effluent from hydrocarbon pyrolysis, e.g., from steam cracking, is typically in the form of a mixture comprising unreacted feed, unsaturated hydrocarbon produced from the feed during the pyrolysis, and pyrolysis tar. The pyrolysis tar typically comprises ≥90 wt. %, of the pyrolysis effluent's molecules having an atmospheric boiling point of ≥290° C. Besides hydrocarbon, the feed to pyrolysis optionally further comprise diluent, e.g., one or more of nitrogen, water, etc. Steam cracking, which produces SCT, is a form of pyrolysis which uses a diluent comprising an appreciable amount of steam. Steam cracking will now be described in more detail.

The invention is not limited to pyrolysis tars produced by steam cracking, and this description is not meant to foreclose producing pyrolysis tar by other pyrolysis methods within the broader scope of the invention.

Steam Cracking

A steam cracking plant typically comprises a furnace facility for producing steam cracking effluent and a recovery facility for removing from the steam cracking effluent a plurality of products and by-products, e.g., light olefin and pyrolysis tar. The furnace facility generally includes a plurality of steam cracking furnaces. Steam cracking furnaces typically include two main sections: a convection section and a radiant section, the radiant section typically containing fired heaters. Flue gas from the fired heaters is conveyed out of the radiant section to the convection section. The flue gas flows through the convection section and is then conducted away, e.g., to one or more treatments for removing combustion by-products such as $NO_x$. Hydrocarbon is introduced into tubular coils (convection coils) located in the convection section. Steam is also introduced into the coils, where it combines with the hydrocarbon to produce a steam cracking feed. The combination of indirect heating by the flue gas and direct heating by the steam leads to vaporization of at least a portion of the steam cracking feed's hydrocarbon component. The steam cracking feed containing the vaporized hydrocarbon component is then transferred from the convection coils to tubular radiant tubes located in the radiant section. Indirect heating of the steam cracking feed in the radiant tubes results in cracking of at least a portion of the steam cracking feed's hydrocarbon component. Steam cracking conditions in the radiant section, can include, e.g., one or more of (i) a temperature in the range of 760° C. to 880° C.; (ii) a pressure in the range of from 1.0 to 5.0 bars (absolute); or (iii) a cracking residence time in the range of from 0.10 to 2.0 seconds.

Steam cracking effluent is conducted out of the radiant section and is quenched, typically with water or quench oil. The quenched steam cracking effluent ("quenched effluent") is conducted away from the furnace facility to the recovery facility, for separation and recovery of reacted and unreacted components of the steam cracking feed. The recovery facility typically includes at least one separation stage, e.g., for separating from the quenched effluent one or more of light olefin, steam cracker naphtha, steam cracker gas oil, SCT, water, light saturated hydrocarbon, molecular hydrogen, etc.

Steam cracking feed typically comprises hydrocarbon and steam, e.g., ≥10.0 wt. % hydrocarbon, based on the weight of the steam cracking feed, e.g., ≥25.0 wt. %, ≥50.0 wt. %, such as ≥65 wt. %. Although the hydrocarbon can comprise one or more light hydrocarbons such as methane, ethane, propane, butane etc., it can be particularly advantageous to include a significant amount of higher molecular weight hydrocarbon. While doing so typically decreases feed cost, steam cracking such a feed typically increases the amount of SCT in the steam cracking effluent. One suitable steam cracking feed comprises ≥1.0 wt. %, e.g., ≥10 wt. %, such as ≥25.0 wt. %, or ≥50.0 wt. % (based on the weight of the steam cracking feed) of hydrocarbon compounds that are in the liquid and/or solid phase at ambient temperature and atmospheric pressure.

The steam cracking feed comprises water and hydrocarbon. The hydrocarbon typically comprises ≥10.0 wt. %, e.g., ≥50.0 wt. %, such as ≥90.0 wt. % (based on the weight of the hydrocarbon) of one or more of naphtha, gas oil, vacuum gas oil, waxy residues, atmospheric residues, residue admixtures, or crude oil; including those comprising ≥ about 0.1 wt. % asphaltenes. When the hydrocarbon includes crude oil and/or one or more fractions thereof, the crude oil is optionally desalted prior to being included in the steam cracking feed. A crude oil fraction can be produced by separating atmospheric pipestill ("APS") bottoms from a crude oil followed by vacuum pipestill ("VPS") treatment of the APS bottoms. One or more vapor-liquid separators can be used upstream of the radiant section, e.g., for separating and conducting away a portion of any non-volatiles in the crude oil or crude oil components. In certain aspects, such a separation stage is integrated with the steam cracker by preheating the crude oil or fraction thereof in the convection section (and optionally by adding of dilution steam), separating a bottoms steam comprising non-volatiles, and then conducting a primarily vapor overhead stream as feed to the radiant section.

Suitable crude oils include, e.g., high-sulfur virgin crude oils, such as those rich in polycyclic aromatics. For example, the steam cracking feed's hydrocarbon can include ≥90.0 wt. % of one or more crude oils and/or one or more crude oil fractions, such as those obtained from an atmospheric APS and/or VPS; waxy residues; atmospheric residues; naphthas contaminated with crude; various residue admixtures; and SCT.

SCT is typically removed from the quenched effluent in one or more separation stages, e.g., as a bottoms stream from one or more tar drums. Such a bottoms stream typically comprises ≥90.0 wt. % SCT, based on the weight of the bottoms stream. The SCT can have, e.g., a boiling range ≥ about 550° F. (290° C.) and can comprise molecules and mixtures thereof having a number of carbon atoms ≥ about 15. Typically, quenched effluent includes ≥1.0 wt. % of $C_2$ unsaturates and ≥0.1 wt. % of TH, the weight percents being based on the weight of the pyrolysis effluent. It is also typical for the quenched effluent to comprise ≥0.5 wt. % of TH, such as ≥1.0 wt. % TH.

Representative SCTs will now be described in more detail. The invention is not limited to these SCTs, and this description is not meant to foreclose the processing of other pyrolysis tars within the broader scope of the invention.

Steam Cracker Tar

Conventional separation equipment can be used for separating SCT and other products and by-products from the quenched steam cracking effluent, e.g., one or more flash drums, knock out drums, fractionators, water-quench towers, indirect condensers, etc. Suitable separation stages are described in U.S. Pat. No. 8,083,931, for example. SCT can be obtained from the quenched effluent itself and/or from one or more streams that have been separated from the quenched effluent. For example, SCT can be obtained from a steam cracker gas oil stream and/or a bottoms stream of the steam cracker's primary fractionator, from flash-drum bottoms (e.g., the bottoms of one or more tar knock out drums located downstream of the pyrolysis furnace and upstream of the primary fractionator), or a combination thereof. Certain SCTs are a mixture of primary fractionator bottoms and tar knock-out drum bottoms.

A typical SCT stream from one or more of these sources generally contains ≥90.0 wt. % of SCT, based on the weight of the stream, e.g., ≥95.0 wt. %, such as ≥99.0 wt. %. More than 90 wt. % of the remainder of the SCT stream's weight (e.g., the part of the stream that is not SCT, if any) is typically particulates. The SCT typically includes ≥50.0 wt. %, e.g., ≥75.0 wt. %, such as ≥90.0 wt. % of the quenched effluent's TH, based on the total weight TH in the quenched effluent.

The TH are typically in the form of aggregates which include hydrogen and carbon and which have an average size in the range of 10.0 nm to 300.0 nm in at least one dimension and an average number of carbon atoms ≥50. Generally, the TH comprise ≥50.0 wt. %, e.g., ≥80.0 wt. %, such as ≥90.0 wt. % of aggregates having a C:H atomic ratio in the range of from 1.0 to 1.8, a molecular weight in the range of 250 to 5000, and a melting point in the range of 100° C. to 700° C.

Representative SCTs typically have (i) a TH content in the range of from 5.0 wt. % to 40.0 wt. %, based on the weight of the SCT; (ii) an API gravity (measured at a temperature of 15.8° C.) of ≤8.5° API, such as ≤8.0° API, or ≤7.5° API; and (iii) a 50° C. viscosity in the range of 200 cSt to $1.0\times10^7$ cSt, e.g., $1\times10^3$ cSt to $1.0\times10^7$ cSt, as determined by A.S.T.M. D445. The SCT can have, e.g., a sulfur content that is >0.5 wt. %, or >1 wt. %, or more, e.g., in the range of 0.5 wt. % to 7.0 wt. %, based on the weight of the SCT. In aspects where steam cracking feed does not contain an appreciable amount of sulfur, the SCT can comprise ≤0.5 wt. % sulfur, e.g., ≤0.1 wt. %, such as ≤0.05 wt. % sulfur, based on the weight of the SCT.

The SCT can have, e.g., (i) a TH content in the range of from 5.0 wt. % to 40.0 wt. %, based on the weight of the SCT; (ii) a density at 15° C. in the range of 1.01 g/cm$^3$ to 1.19 g/cm$^3$, e.g., in the range of 1.07 g/cm$^3$ to 1.18 g/cm$^3$; and (iii) a 50° C. viscosity ≥200 cSt, e.g., ≥600 cSt, or in the range of from 200 cSt to $1.0\times10^7$ cSt. The specified hydroprocessing is particularly advantageous for SCTs having 15° C. density that is ≥1.10 g/cm$^3$, e.g., ≥1.12 g/cm$^3$, ≥1.14 g/cm$^3$, ≥1.16 g/cm$^3$, or ≥1.17 g/cm$^3$. Optionally, the SCT has a 50° C. kinematic viscosity $\geq1.0\times10^4$ cSt, such as $\geq1.0\times10^5$ cSt, or $\geq1.0\times10^6$ cSt, or even $\geq1.0\times10^7$ cSt. Optionally, the SCT has an $I_N$ >80 and >70 wt. % of the pyrolysis tar's molecules have an atmospheric boiling point of ≥290° C. Typically, the SCT has an insoluble content ("$IC_T$") ≥0.5 wt. %, e.g., ≥1 wt. %, such as ≥2 wt. %, or ≥4 wt. %, or ≥5 wt. %, or ≥10 wt. %.

Optionally, the SCT has a normal boiling point ≥290° C., a 15° C. kinematic viscosity $\geq1\times10^4$ cSt, and a density ≥1.1 g/cm$^3$. The SCT can be a mixture which includes a first SCT and one or more additional pyrolysis tars, e.g., a combination of the first SCT and one or more additional SCTs. When the SCT is a mixture, it is typical for at least 70 wt. % of the mixture to have a normal boiling point of at least 290° C., and include olefinic hydrocarbon which contribute to the tar's reactivity under hydroprocessing conditions. When the mixture comprises a first and second pyrolysis tars (one or more of which is optionally an SCT) ≥90 wt. % of the second pyrolysis tar optionally has a normal boiling point ≥290° C.

It has been found that an increase in reactor fouling occurs during hydroprocessing of a tar-fluid mixture comprising an SCT having an excessive amount of olefinic hydrocarbon. In order to lessen the amount of reactor fouling, it is beneficial for an SCT in the tar-fluid mixture to have an olefin content of ≤10.0 wt. % (based on the weight of the SCT), e.g., ≤5.0 wt. %, such as ≤2.0 wt. %. More particularly, it has been observed that less reactor fouling occurs during the hydroprocessing when the SCT in the tar-fluid mixture has (i) an amount of vinyl aromatics of ≤5.0 wt. % (based on the weight of the SCT), e.g., ≤3 wt. %, such as ≤2.0 wt. % and/or (ii) an amount of aggregates which incorporate vinyl aromatics of ≤5.0 wt. % (based on the weight of the SCT), e.g., ≤3 wt. %, such as ≤2.0 wt. %.

Certain aspects of the invention include thermally treating the SCT to producer an SCT composition, combining the SCT composition with a specified amount of a specified utility fluid to produce a tar-fluid mixture, hydroprocessing the tar-fluid mixture in a pretreatment reactor under Pretreatment Hydroprocessing Conditions, to produce a pretreater effluent, and hydroprocessing at least a portion of the pretreater effluent under Intermediate Hydroprocessing Conditions to produce a hydroprocessor effluent comprising hydroprocessed SCT.

Certain aspects of the thermal treatment will now be described in more detail with respect to a representative pyrolysis tar. The invention is not limited to these aspects, and this description is not meant to foreclose other thermal treatments within the broader scope of the invention.

Thermal Treatment

Pyrolysis tar reactivity can be decreased (e.g., improved) by one or more thermal treatments. Typically, the thermal treatment is carried out using a pyrolysis tar feed of reactivity $R_T$ to produce a pyrolysis tar composition having a lesser reactivity $R_C$. Conventional thermal treatments are suitable for heat treating pyrolysis tar, including heat soaking, but the invention is not limited thereto. Although reactivity can be improved by blending the pyrolysis tar with a second pyrolysis tar of lesser olefinic hydrocarbon content, it is more typical to thermally treat the pyrolysis tar to achieve an $R_C$ ≤28 BN, e.g., ≤26 BN, such as ≤24 BN, or ≤22 BN, or ≤20 BN. It is believed that the specified thermal treatment is particularly effective for decreasing the tar's aliphatic olefin content. For example, combining a thermally-treated SCT (the pyrolysis tar composition) with the specified utility fluid in the specified relative amounts typically produces a tar-fluid mixture having an $R_M$ ≤18 BN. If substantially the same SCT is combined with substantially the same utility fluid in substantially the same relative amounts without thermally-treating the tar, the tar-fluid mixture typically has an $R_M$ in the range of from 19 BN to 35 BN.

One representative pyrolysis tar is an SCT ("SCT1") having an $R_T$ >28 BN (on a tar basis), such as $R_T$ of about 35 BN; a density at 15° C. that is ≥1.10 g/cm$^3$; a 50° C. kinematic viscosity in the range of $\geq1.0\times10^4$ cSt; an $I_N$ >80; wherein ≥70 wt. % of SCT1's hydrocarbon components have an atmospheric boiling point of ≥290° C. SCT1 can be obtained from an SCT source, e.g., from the bottoms of a separator drum (such as a tar drum) located downstream of steam cracker effluent quenching. The thermal treatment can include maintaining SCT1 to a temperature in the range of from $T_1$ to $T_2$ for a time $\geq t_{HS}$. $T_1$ is ≥150° C., e.g., ≥160° C., such as ≥170° C., or ≥180° C., or ≥190° C., or ≥200° C. $T_2$ is ≤320° C., e.g., ≤310°, such as ≤300° C., or ≤290° C., and $T_2$ is $\geq T_1$. $t_{HS}$ is ≥1 min., e.g., ≥10 min., such as ≥100 min., or typically in the range of from 1 min. to 400 min. Provided $T_2$ is ≤320° C., utilizing a $t_{HS}$ of ≥10 min., e.g., ≥50 min., such as ≥100 min. typically produces a treated tar having better properties than those treated for a lesser $t_{HS}$.

Although the invention is not limited thereto, the heating can be carried out in a lower section of a tar knockout drum and/or in SCT piping and equipment associated with the tar knockout drum. For example, it is typical for a tar drum to receive quenched steam cracker effluent containing SCT. While the steam cracker is operating in pyrolysis mode, SCT accumulates in a lower region of the tar drum, from which the SCT is continuously withdrawn. A portion of the withdrawn SCT can be reserved for measuring one or more of $R_T$ and $R_M$. The remainder of the withdrawn SCT can be conducted away from the tar drum and divided into two separate SCT streams. At least a portion of the first stream (a recycle portion) is recycled to the lower region of the tar drum. At least a recycle portion of the second stream is also recycled to the lower region of the tar drum, e.g., separately or together with the recycle portion of the first stream. Typically, ≥75 wt. % of the first stream resides in the recycled portion, e.g., ≥80 wt. %, or ≥90 wt. %, or ≥95 wt. %. Typically, ≥40 wt. % of the second stream resides in the recycled portion, e.g., ≥50 wt. %, or ≥60 wt. %, or ≥70 wt. %. Optionally, a storage portion is also divided from the second stream, e.g., for storage in tar tankage. Typically, the storage portion is ≥90 wt. % of the remainder of the second stream after the recycle portion is removed. The thermal treatment temperate range and $t_{HS}$ can be controlled by regulating flow rates to the tar drum of the first and/or second recycle streams.

Typically, the recycle portion of the first stream has an average temperature that is no more than 60° C. below the average temperature of the SCT in the lower region of the tar drum, e.g., no more than 50° C. below, or no more than 25° C. below, or no more than 10° C. below. This can be achieved, e.g., by thermally insulating the piping and equipment for conveying the first stream to the tar drum. The second stream, or the recycle portion thereof, is cooled to an average temperature that is (i) less than that of the recycle portion of the first stream and (ii) at least 60° C. less than the average temperature of the SCT in the lower region of the tar drum, e.g., at least 70° C. less, such as at least 80° C. less, or at least 90° C. less, or at least 100° C. less. This can be achieved by cooling the second stream, e.g., using one or more heat exchangers. Utility fluid can be added to the second stream as a flux if needed. If utility fluid is added to the second stream, the amount of added utility fluid flux is taken into account when additional utility fluid is combined with SCT to produce a tar-fluid mixture to achieve a desired tar:fluid weight ratio within the specified range.

The thermal treatment is typically controlled by regulating (i) the weight ratio of the recycled portion of the second stream: the withdrawn SCT stream and (ii) the weight ratio of the recycle portion of the first stream:recycle portion of the second stream. Controlling one or both of these ratios has been found to be effective for maintaining and average temperature of the SCT in the lower region of the tar drum in the desired ranges of $T_1$ to $T_2$ for a treatment time $t_{HS}$ ≥1 minute. A greater SCT recycle rate corresponds to a greater SCT residence time at elevated temperature in the tar drum and associated piping, and typically increases the height of the tar drum's liquid level (the height of liquid SCT in the lower region of the tar drum, e.g., proximate to the boot region). Typically, the weight ratio of the recycled portion of the second stream:the withdrawn SCT stream is ≤0.5, e.g., ≤0.4, such as ≤0.3, or ≤0.2, or in the range of from 0.1 to 0.5. Typically, the weight ratio of the recycle portion of the first stream:recycle portion of the second stream is ≤5, e.g., ≤4, such as ≤3, or ≤2, or ≤1, or ≤0.9, or ≤0.8, or in the range of from 0.6 to 5. Although it is not required to maintain the average temperature of the SCT in the lower region of the tar drum at a substantially constant value ($T_{HS}$), it is typical to do so. $T_{HS}$ can be, e.g., in the range of from 150° C. to 320° C., such as 160° C. to 310° C., or ≥170° C. to 300° C. In certain aspects, the thermal treatment conditions include (i) $T_{HS}$ is at least 10° C. greater than $T_1$ and (ii) $T_{HS}$ is in the range of 150° C. to 320° C. For example, typical $T_{HS}$ and $t_{HS}$ ranges include 180° C.≤$T_{HS}$≤320° C. and 5 minutes≤$t_{HS}$≤100 minutes; e.g., 200° C.≤$T_{HS}$≤280° C. and 5 minute≤$t_{HS}$≤30 minutes. Provided $T_{HS}$ is ≤320° C., utilizing a $t_{HS}$ of ≥10 min., e.g., ≥50 min, such as ≥100 min typically produces a better treated tar over those produced at a lesser $t_{HS}$.

The specified thermal treatment is effective for decreasing the representative SCT's reactivity to achieve an $R_C \leq R_T - 0.5$ BN, e.g., $R_C \leq R_T - 1$ BN, such as $R_C \leq R_T - 2$ BN, or $R_C \leq R_T - 4$ BN, or $R_C \leq R_T - 8$ BN, or $R_C \leq R_T - 10$ BN. $R_M$ is typically ≤18 BN, e.g., ≤17 BN, such as 12 BN<$R_M$≤18 BN. In certain aspects, the thermal treatment results in the tar-fluid mixtures having an $R_M$<17 BN, e.g., ≤16 BN, such as ≤12 BN, or ≤10 BN, or ≤8 BN. Carrying out the thermal treatment at a temperature in the specified temperature range of $T_1$ to $T_2$ for the specified time $t_{HS}$ ≥1 minute is beneficial in that the treated tar (the pyrolysis tar composition) has an insolubles content ("$IC_C$") that is less than that of a treated tar obtained by thermal treatments carried out at a greater temperature. This is particularly the case when $T_{HS}$ is ≤320° C., e.g., ≤300° C., such as ≤250° C., or ≤200° C., and $t_{HS}$ is ≥10 minutes, such as ≥100 minutes. The favorable $IC_C$ content, e.g. ≤6 wt. %, and typically ≤5 wt. %, or ≤3 wt. %, or ≤2 wt. %, increases the suitability of the thermally-treated tar for use as a fuel oil, e.g., a transportation fuel oil, such as a marine fuel oil. It also decreases the need for solids-removal before hydroprocessing. Generally, $IC_C$ is about the same as or is not appreciably greater $IC_T$. $IC_C$ typically does not exceed $IC_T$+3 wt. %, e.g., $IC_C \leq IC_T$+2 wt. %, such as $IC_C \leq IC_T$+1 wt. %, or $IC_C \leq IC_T$+0.1 wt. %.

Although it is typical to carry out SCT thermal treatment in one or more tar drums and related piping, the invention is not limited thereto For example, when the thermal treatment includes heat soaking, the heat soaking can be carried out at least in part in one or more soaker drums and/or in vessels, conduits, and other equipment (e.g. fractionators, water-quench towers, indirect condensers) associated with, e.g., (i) separating the pyrolysis tar from the pyrolysis effluent and/or (ii) conveying the pyrolysis tar to hydroprocessing. The location of the thermal treatment is not critical. The thermal treatment can be carried out at any convenient location, e.g., after tar separation from the pyrolysis effluent and before hydroprocessing, such as downstream of a tar drum and upstream of mixing the thermally treated tar with utility fluid.

In certain aspects, the thermal treatment is carried out as illustrated schematically in FIG. 1. As shown, quenched effluent from a steam cracker furnace facility is conducted via line 61 to a tar knock out drum 62. Cracked gas is removed from the drum via line 54. SCT condenses in the lower region of the drum (the boot region as shown), and a withdrawn stream of SCT is conducted away from the drum via line 63 to pump 64. After pump 64, a first recycle stream 58 and a second recycle stream 57 are diverted from the withdrawn stream. The first and second recycle streams are combined as recycle to drum 62 via line 59. One or more heat exchangers 55 is provided for cooling the SCT in lines 57 and 65, e.g., against water (not shown). Line 56 provides an optional flux of utility fluid if needed. Valves $V_1$, $V_2$, and $V_3$ regulate the amounts of the withdrawn stream that are directed to the first recycle stream, the second recycle stream, and a stream conducted for hydroprocessing via line 65. Lines 58, 59, and 63 can be insulated to maintain the temperature of the SCT within the desired temperature range for the thermal treatment. The thermal treatment time $t_{HS}$ can be increased by increasing SCT flow through valves $V_1$ and $V_2$, which raises the SCT liquid level in drum 62 from an initial level, e.g., $L_1$, toward $L_2$.

Thermally-treated SCT is conducted through valve $V_3$ and via line 65 toward a hydroprocessing facility comprising at least one hydroprocessing reactor. In the aspects illustrated in FIG. 1 using a representative SCT such as SCT1, the average temperature $T_{HS}$ of the SCT during thermal treatment in the lower region of tar drum (below $L_2$) is in the range of from 200° C. to 275° C., and heat exchanger 55 cools the recycle portion of the second stream to a temperature in the range of from 60° C. to 80° C. Time $t_{HS}$ can be, e.g., ≥10 min., such as in the range of from 10 min. to 30 min., or 15 min. to 25 min.

In continuous operation, the SCT conducted via line 65 typically comprises ≥50 wt. % of SCT available for processing in drum 62, such as SCT, e.g., ≥75 wt. %, such as ≥90 wt. %. In certain aspects, substantially all of the SCT available for hydroprocessing is combined with the specified amount of the specified utility fluid to produce a tar-fluid mixture which is conducted to hydroprocessing. Depending, e.g., on hydroprocessor capacity limitations, a portion of the SCT in line 64 can be conducted away, such as for storage or further processing, including storage followed by hydroprocessing.

In addition to the indicated thermal treatment, the pyrolysis tar is optionally treated to remove solids, particularly those having a particle size ≥10,000 μm. Solids can be removed before and/or after the thermal treatment. For example, the tar can be thermally-treated and combined with utility fluid to form a tar-fluid mixture from which the solids are removed. Alternatively or in addition, solids can be removed before or after any hydroprocessing stage. Although it is not limited thereto, the invention is compatible with conventional solid-removal technology such as that disclosed in U.S. Patent Application Publication No. 2015-0361354, which is incorporated by reference herein in its entirety. For example, solids can be removed from the tar-fluid mixture in a temperature in the range of from 80° C. to 100° C. using a centrifuge.

Certain utility fluids and tar-fluid mixtures will now be described in more detail. The invention is not limited to these, and this description is not meant to foreclose using other utility fluids and tar-fluid mixtures within the broader scope of the invention.

Utility Fluids

The utility fluid typically comprises a mixture of multi-ring compounds. The rings can be aromatic or non-aromatic, and can contain a variety of substituents and/or heteroatoms. For example, the utility fluid can contain ring compounds in an amount ≥40.0 wt. %, ≥45.0 wt. %, ≥50.0 wt. %, ≥55.0 wt. %, or ≥60.0 wt. %, based on the weight of the utility fluid. In certain aspects, at least a portion of the utility fluid is obtained from the hydroprocessor effluent, e.g., by one or more separations. This can be carried out as disclosed in U.S. Pat. No. 9,090,836, which is incorporated by reference herein in its entirety.

Typically, the utility fluid comprises aromatic hydrocarbon, e.g., ≥25.0 wt. %, such as ≥40.0 wt. %, or ≥50.0 wt. %, or ≥55.0 wt. %, or ≥60.0 wt. % of aromatic hydrocarbon, based on the weight of the utility fluid. The aromatic hydrocarbon can include, e.g., one, two, and three ring aromatic hydrocarbon compounds. For example, the utility fluid can comprise ≥15 wt. % of 2-ring and/or 3-ring aromatics, based on the weight of the utility fluid, such as ≥20 wt. %, or ≥25.0 wt. %, or ≥40.0 wt. %, or ≥50.0 wt. %, or ≥55.0 wt. %, or ≥60.0 wt. %. Utilizing a utility fluid comprising aromatic hydrocarbon compounds having 2-rings and/or 3-rings is advantageous because utility fluids containing these compounds typically exhibit an appreciable $S_{BN}$.

The utility fluid typically has an A.S.T.M. D86 10% distillation point ≥60° C. and a 90% distillation point ≤425° C., e.g., ≤400° C. In certain aspects, the utility fluid has a true boiling point distribution with an initial boiling point ≥130° C. (266° F.) and a final boiling point ≤566° C. (1050° F.). In other aspects, the utility fluid has a true boiling point distribution with an initial boiling point ≥150° C. (300° F.) and a final boiling point ≤430° C. (806° F.). In still other aspects, the utility has a true boiling point distribution with an initial boiling point ≥177° C. (350° F.) and a final boiling point ≤425° C. (797° F.). True boiling point distributions (the distribution at atmospheric pressure) can be determined, e.g., by conventional methods such as the method of A.S.T.M. D7500. When the final boiling point is greater than that specified in the standard, the true boiling point distribution can be determined by extrapolation. A particular form of the utility fluid has a true boiling point distribution having an initial boiling point ≥130° C. and a final boiling point ≤566° C.; and/or comprises ≥15 wt. % of two ring and/or three ring aromatic compounds.

The tar-fluid mixture can be produced by combining the specified pyrolysis tar composition of reactivity $R_C$ with a sufficient amount of utility fluid for the tar-fluid mixture to have a viscosity that is sufficiently low for the tar-fluid mixture to be conveyed to pretreatment hydroprocessing, e.g., a 50° C. kinematic viscosity of the tar-fluid mixture that is ≤500 cSt. The amounts of utility fluid and pyrolysis tar in the tar-fluid mixture to achieve such a viscosity are generally in the range of from about 20.0 wt. % to about 95.0 wt. % of the pyrolysis tar and from about 5.0 wt. % to about 80.0 wt. % of the utility fluid, based on total weight of tar-fluid mixture. For example, the relative amounts of utility fluid and pyrolysis tar in the tar-fluid mixture can be in the range of (i) about 20.0 wt. % to about 90.0 wt. % of the pyrolysis tar and about 10.0 wt. % to about 80.0 wt. % of the utility fluid, or (ii) from about 40.0 wt. % to about 90.0 wt. % of the pyrolysis tar and from about 10.0 wt. % to about 60.0 wt. % of the utility fluid. The utility fluid: pyrolysis tar weight ratio is typically ≥0.01, e.g., in the range of 0.05 to 4.0, such as in the range of 0.1 to 3.0, or 0.3 to 1.1. In certain aspects, particularly when the pyrolysis tar comprises a representative SCT, the tar-fluid mixture can comprise 50 wt. % to 70 wt. % of the pyrolysis tar composition, with ≥90 wt. % of the balance of the tar-fluid mixture comprising the specified utility fluid, e.g., ≥95 wt. %, such as ≥99 wt. Although the utility fluid can be combines with the pyrolysis tar composition to produce the tar-fluid mixture within the hydroprocessing stage, it is typical to combine the pyrolysis tar composition and utility fluid upstream of the pretreatment hydroprocessing, e.g., by adding utility fluid to the pyrolysis tar composition.

In certain aspects, the pyrolysis tar composition is combined with a utility fluid to produce a tar-fluid mixture for pretreatment in a pretreatment reactor operating under Pretreatment Hydroprocessing Conditions. Typically these aspects feature one or more of (i) a utility fluid having an $S_{BN}$ ≥100, e.g., $S_{BN}$ ≥110; and (ii) the pyrolysis tar composition is produced by the specified thermal treatment of a pyrolysis tar having an $I_N$ ≥70, e.g., ≥80, where ≥70 wt. % of the pyrolysis tar resides in compositions having an atmospheric boiling point ≥290° C., e.g., ≥80 wt. %, or ≥90 wt. %. The tar-fluid mixture can have, e.g., an $S_{BN}$ ≥110, such as ≥120, or ≥130. It has been found that there is a beneficial decrease in reactor plugging when hydroprocessing pyrolysis tars having an $I_N$>110 provided that, after being combined with the utility fluid, the pretreatment hydroprocessor feed (the tar-fluid mixture) has an $S_{BN}$ ≥150, ≥155, or ≥160. The pyrolysis tar composition can have a relatively large insolubility number, e.g., $I_N$ >80, especially >100, or >110, provided the utility fluid has relatively large $S_{BN}$, e.g., ≥100, ≥120, or ≥140.

Certain forms of the pretreatment reactor will now be described with continued reference to FIG. 1. In these aspects, the tar-fluid mixture is hydroprocessed under the specified Pretreatment Hydroprocessing Conditions to produce a pretreater effluent. The invention is not limited to these aspects, and this description is not meant to foreclose other aspects within the broader scope of the invention.

Pretreatment Hydroprocessing of the Tar-Fluid Mixture

The SCT composition is combined with utility fluid to produce a tar-fluid mixture which is hydroprocessed in the presence of molecular hydrogen under Pretreatment Hydroprocessing Conditions to produce a pretreater effluent. The pretreatment hydroprocessing is typically carried out in at least one hydroprocessing zone located in at least one pretreatment reactor. The pretreatment reactor can be in the form of a conventional hydroprocessing reactor, but the invention is not limited thereto.

The pretreatment hydroprocessing is carried out under Pretreatment Hydroprocessing Conditions, e.g., one or more of $T_{PT}$ ≥150° C., e.g., ≥200° C. but less than $T_I$ (e.g., $T_{PT} \leq T_1 - 10°$ C., such as $T_{PT} \leq T_1 - 25°$ C., such as $T_{PT} \leq T_1 - 50°$ C.), a total pressure $P_{PT}$ that is ≥8 MPa but less than $P_I$, $WHSV_{PT}$ ≥0.3 $hr^{-1}$ and greater than $WHSV_I$ (e.g., $WHSV_{PT} > WHSV_I + 0.01\ hr^{-1}$, such as $\geq WHSV_I + 0.05\ hr^{-1}$, or $\geq WHSV_I + 0.1\ hr^{-1}$, or $\geq WHSV_I + 0.5\ hr^{-1}$, or $\geq WHSV_I + 1\ hr^{-1}$, or $\geq WHSV_I + 10\ hr^{-1}$, or more), and a molecular hydrogen consumption rate in the range of from 150 standard cubic meters of molecular hydrogen per cubic meter of the pyrolysis tar (S $m^3/m^3$) to about 400 S $m^3/m^3$ (845 SCF/B to 2250 SCF/B) but less than that of intermediate hydroprocessing. The Pretreatment Hydroprocessing Conditions typically include $T_{PT}$ in the range of from 260° C. to 300° C.; $WHSV_{PT}$ in the range of from 1.5 $hr^{-1}$ to 3.5 $hr^{-1}$, e.g., 2 $hr^{-1}$ to 3 $hr^{-1}$; a $P_{PT}$ in the range of from 6 MPa to 13.1 MPa; and a molecular hydrogen consumption rate in the range of from 100 standard cubic feet per barrel of the pyrolysis tar composition in the tar-fluid mixture (SCF/B) (18 S $m^3/m^3$) to 600 SCF/B (107 S $m^3/m^3$). Although the amount of molecular hydrogen supplied to a hydroprocessing stage operating under Pretreatment Hydroprocessing Conditions is generally selected to achieve the desired molecular hydrogen partial pressure, it is typically in a range of about 300 standard cubic feet per barrel of tar-fluid mixture (SCF/B) (53 S $m^3/m^3$) to 1000 SCF/B (178 S $m^3/m^3$). Using the specified Pretreatment Hydroprocessing Conditions results in an appreciably longer hydroprocessing duration without significant reactor fouling (e.g., as evidenced by no significant increase in hydroprocessing reactor pressure drop) than is the case when hydroprocessing a substantially similar tar-fluid mixture under more sever conditions, e.g., under Intermediate Hydroprocessing Conditions. The duration of pretreatment hydroprocessing without significantly fouling is typically at least 10 times longer than would be the case if more severe hydroprocessing conditions were used, e.g., ≥100 times longer, such as ≥1000 times longer. Although the pretreatment can be carried out within one pretreatment reactor, it is within the scope of the invention to use two or more reactors in series. For example, first and second pretreatment reactors can be used, where the first pretreatment reactor operates at a lower temperature and greater space velocity within the Pretreatment Hydroprocessing Conditions than the second pretreatment reactor. Alternatively or in addition, a plurality of pretreatment reactors can be operated in parallel, e.g., with a first pretreatment reactor (or a first sequence of pretreatment reactors operating in series) operating in pretreatment mode and a second pretreatment reactor (or a second sequence of pretreatment reactors operating in series) operating in regeneration mode.

Pretreatment hydroprocessing is carried out in the presence of hydrogen, e.g., by (i) combining molecular hydrogen with the tar-fluid mixture upstream of the pretreatment hydroprocessing and/or (ii) conducting molecular hydrogen to the pretreatment hydroprocessing in one or more conduits or lines. Although relatively pure molecular hydrogen can be utilized for the hydroprocessing, it is generally desirable to utilize a "treat gas" which contains sufficient molecular hydrogen for the pretreatment hydroprocessing and optionally other species (e.g., nitrogen and light hydrocarbons such as methane) which generally do not adversely interfere with or affect either the reactions or the products. The treat gas optionally contains ≥ about 50 vol. % of molecular hydrogen, e.g., ≥75 vol. %, such as ≥90 wt. %, based on the total volume of treat gas conducted to the pretreatment hydroprocessing stage.

Typically, the pretreatment hydroprocessing in at least one hydroprocessing zone of the pretreatment reactor is carried out in the presence of a catalytically-effective amount of at least one catalyst having activity for hydrocarbon hydroprocessing. Conventional hydroprocessing catalysts can be utilized for pretreatment hydroprocessing, such as those specified for use in resid and/or heavy oil hydroprocessing, but the invention is not limited thereto. Suitable pretreatment hydroprocessing catalysts include bulk metallic catalysts and supported catalysts. The metals can be in elemental form or in the form of a compound. Typically, the catalyst includes at least one metal from any of Groups 5 to 10 of the Periodic Table of the Elements (tabulated as the Periodic Chart of the Elements, The Merck Index, Merck & Co., Inc., 1996). Examples of such catalytic metals include, but are not limited to, vanadium, chromium, molybdenum, tungsten, manganese, technetium, rhenium, iron, cobalt, nickel, ruthenium, palladium, rhodium, osmium, iridium, platinum, or mixtures thereof. Suitable conventional catalysts include one or more of $R_T$-621, which is described as a resid conversion catalyst in Advances of Chemical Engineering 14, table XXIII, Academic Press, 1989; KF860 available from Albemarle Catalysts Company LP, Houston Tex.; Nebula® Catalyst, such as Nebula® 20, available from the same source; Centera® catalyst, available from Criterion Catalysts and Technologies, Houston Tex., such as one or more of DC-2618, DN-2630, DC-2635, and DN-3636; Ascent® Catalyst, available from the same source, such as one or more of DC-2532, DC-2534, and DN-3531; and FCC pre-treat catalyst, such as DN3651 and/or DN3551, available from the same source.

In certain aspects, the catalyst has a total amount of Groups 5 to 10 metals per gram of catalyst of at least 0.0001 grams, or at least 0.001 grams or at least 0.01 grams, in which grams are calculated on an elemental basis. For example, the catalyst can comprise a total amount of Group 5 to 10 metals in a range of from 0.0001 grams to 0.6 grams, or from 0.001 grams to 0.3 grams, or from 0.005 grams to 0.1 grams, or from 0.01 grams to 0.08 grams. In particular aspects, the catalyst further comprises at least one Group 15 element. An example of a preferred Group 15 element is phosphorus. When a Group 15 element is utilized, the catalyst can include a total amount of elements of Group 15 in a range of from 0.000001 grams to 0.1 grams, or from 0.00001 grams to 0.06 grams, or from 0.00005 grams to 0.03 grams, or from 0.0001 grams to 0.001 grams, in which grams are calculated on an elemental basis.

Typically, the tar-fluid mixture is primarily in the liquid phase during the pretreatment hydroprocessing. For example, ≥75 wt. % of the tar-fluid mixture is in the liquid phase during the hydroprocessing, such ≥90 wt. %, or ≥99 wt. %. The pretreatment hydroprocessing produces a pretreater effluent which at the pretreatment reactor's outlet comprises (i) a primarily vapor-phase portion including unreacted treat gas, primarily vapor-phase products derived from the treat gas and the tar-fluid mixture, e.g., during the pretreatment hydroprocessing, and (ii) a primarily liquid-phase portion which includes pretreated tar-fluid mixture, unreacted utility fluid, and products, e.g., cracked products, of the pyrolysis tar and/or utility fluid as may be produced during the pretreatment hydroprocessing. The liquid-phase portion (namely the pretreated tar-fluid mixture which comprises the pretreated pyrolysis tar) typically further comprises insolubles and has a reactivity ($R_F$) ≤12 BN, e.g., ≤11 BN, such as ≤10 BN.

Certain aspects of the pretreatment hydroprocessing will now be described in more detail with respect to FIG. 1. As shown in the figure, an SCT composition in line 65 is combined with recovered utility fluid supplied via line 310 to produce the tar-fluid mixture in line 320. Optionally, a supplemental utility fluid, may be added via conduit 330. A first pre-heater 70 preheats the tar-fluid mixture (which typically is primarily in liquid phase), and the pre-heated mixture is conducted to a supplemental pre-heat stage 90 via conduit 370. Supplemental pre-heat stage 90 can be, e.g., a fired heater. Recycled treat gas is obtained from conduit 265 and, if necessary, is mixed with fresh treat gas, supplied through conduit 131. The treat gas is conducted via conduit 60 to a second pre-heater 360, before being conducted to the supplemental pre-heat stage 90 via conduit 80. Fouling in hydroprocessing reactor 110 can be decreased by increasing feed pre-heater duty in pre-heaters 70 and 90.

Continuing with reference to FIG. 1, the pre-heated tar-fluid mixture (from line 380) is combined with the pre-heated treat gas (from line 390) and then conducted via line 410 to pretreatment reactor 400. Mixing means (not shown) can be utilized for combining the pre-heated tar-fluid mixture with the pre-heated treat gas in pretreatment reactor 400, e.g., one or more gas-liquid distributors of the type conventionally utilized in fixed bed reactors. The pretreatment hydroprocessing is carried out in the presence of hydroprocessing catalyst(s) located in at least one catalyst bed 415. Additional catalyst beds, e.g., 416, 417, etc., may be connected in series with catalyst bed 415, optionally with intercooling using treat gas from conduit 60 being provided between beds (not shown). Pretreater effluent is conducted away from pretreatment reactor 400 via conduit 110.

Pretreatment Reactor Regeneration

During pretreatment mode the pressure drop across the pretreatment reactor (ΔP) increases, typically from an initial value of ≤2 psi (14 kPa) to 4 psi (28 kPa) or more. This effect can limit the effective run length of the pretreatment reactor since, e.g., increased reactor ΔP typically correlates with decreased feed conversion and increased yield of undesired reaction products. At the start of pretreatment mode (at time $t_1$), the pretreatment reactor generally exhibits an initial pressure drop ($\Delta P_1$) ≤17 kPa (2.5 psi). The pretreatment is carried out for a pretreatment time of from $t_1$ to $t_2$, where $t_2-t_1$ is the pretreatment mode run length. Time $t_2$ corresponds to the time at which the pretreatment reactor achieves pressure drop ($\Delta P_2$) indicating a need for pretreatment reactor regeneration. The pretreatment is carried out until the pretreatment reactor achieves a $\Delta P_2$ that is the lesser of (i) $F*\Delta P_1$, where F is a factor in the range of from 1.5 to 20, such as from 2 to 10, or 2.5 to 5; or (ii) a threshold pressure drop ≥2 psi (14 kPa), e.g., in the range of from 2 psi (14 kPa) to 10 psi (69 kPa), such as from 3 psi (21 kPa) to 8 psi (55 kPa). The threshold pressure drop and the factor F can each be predetermined, e.g., based on desired pretreatment features, such as one or more of feed conversion, yield of desired products, and yield of undesired products. After $t_2$, i.e., after pressure drop $\Delta P_2$ has been achieved, the pretreatment reactor is switched from pretreatment mode to regeneration mode. Additional pretreatment reactor modes can be carried out between pretreatment mode and regeneration mode, e.g., a mode for purging the pretreatment reactor with a sweep fluid, such as substantially inert gas. Typically, however, regeneration mode follows pretreatment mode with no intervening modes, e.g. beginning at a time at time $t_3$ which follows $t_2$. Generally, the time period between $t_2$ and $t_3$ is short compared to the duration of pretreatment mode, e.g., ≤10 minutes.

Although the flow of pyrolysis tar composition is curtailed or substantially halted at the start of regeneration mode (time $t_3$), a flow of molecular hydrogen is maintained and the pretreatment reactor's total pressure continues to be greater than atmospheric pressure. Particularly when no intervening mode is operated between pretreatment mode and regeneration mode, the pretreatment reactor's pressure drop ΔP at $t_3$ ($\Delta P_3$) is typically substantially the same as the ΔP achieved at $t_2$ ($\Delta P_2$). Pretreatment reactor ΔP decreases during regeneration mode, which continues until the pretreatment reactor ΔP has decreased to a value of $\Delta P_4$, indicating that the pretreatment reactor is sufficiently regenerated for switching back to pretreatment mode at time $t_4$. ΔP can be monitored during regeneration mode, e.g., continuously or semi-continuously (such as one measurement of ΔP per minute), but this is not required. Although $t_4$ and/or $\Delta P_4$ can be predetermined, e.g., a $\Delta P_4$=2 psi (14 kPa) or $L_4-t_3$=24 hours, in certain aspects regeneration mode is carried out until ($\Delta P_4$) is ≤0.5 times $\Delta P_3$. Alternatively or in addition, the pretreatment reactor can be switched from regeneration mode to pretreatment mode after ΔP has been substantially constant for a predetermined time period, e.g., at least one hour. For example, the time at which regeneration mode is concluded ($t_4$) can be the time at which ΔP has varied by less than +/−0.2 psi (1.4 kPa) for at least one hour, such as +/−0.1 psi (0.7 kPa) for one hour, with ΔP at $t_4$ being $\Delta P_4$.

Figure 3:
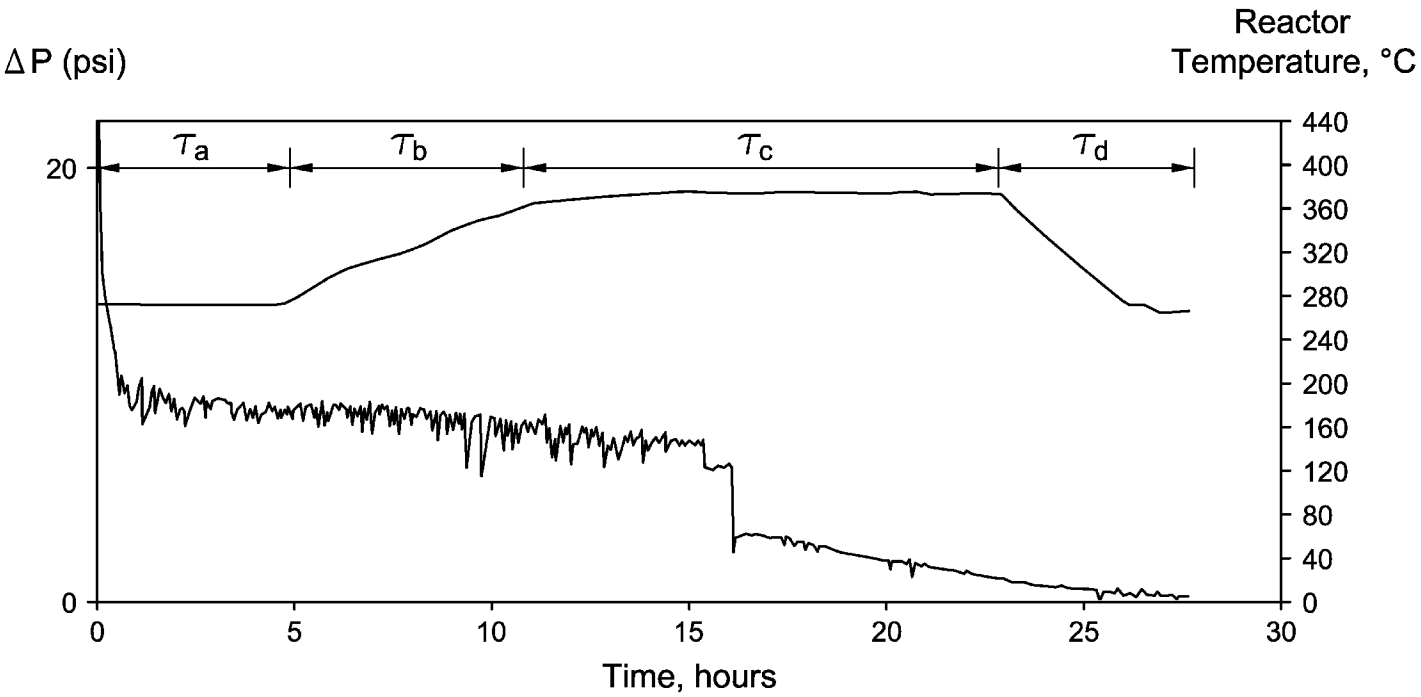
FIG. 3 (upper curve) shows the variation of average catalyst bed temperature in the pretreatment reactor as a function of regeneration time during regeneration mode. The lower curve shows the variation of pretreatment reactor pressure drop (ΔP) over the same time period.

During regeneration mode, the flow of feed (pyrolysis tar composition and/or utility fluid) to the pretreatment reactor is curtailed or substantially discontinued. During regeneration mode, the pretreatment reactor is operated under regeneration conditions, which typically include a temperature ("$T_{Reg}$") ≥$T_{PT}$, a total pressure ("$P_{Reg}$") ≥3.5 MPa, and typically ≥$P_{PT}$; and a molecular hydrogen space velocity (GHSV) ≤750 $hr^{-1}$, e.g., in the range of from 75 $hr^{-1}$ to 750 $hr^{-1}$, such as 100 $hr^{-1}$ to 600 $hr^{-1}$. In particular aspects, the molecular hydrogen GHSV is in the range of from 211 $hr^{-1}$ to 563 $hr^{-1}$ or from 75 $hr^{-1}$ to 250 $hr^{-1}$. Typically, ΔP exhibits a relatively large decrease at the start of regeneration mode, as shown in FIG. 3. While not wishing to be bound by any theory or model, it is believed that this effect results from the purging of liquid from the reactor.

Although regeneration conditions can be substantially constant during regeneration mode, this is not required. In certain aspects regeneration conditions, e.g., $T_{Reg}$, are varied. For example during a first regeneration time period $\tau_a$ which begins at $t_3$, $T_{Reg}$ is maintained substantially constant at a temperature $T_{Reg_a}$, with $T_{Reg_a}$ being substantially the same as $T_{PT}$, such as $T_{PT}$+/−10° C. Although the duration of $\tau_a$ can be for a predetermined time, e.g., 1, 2, 3, 4, or 5 hours (e.g., in the range of from 1 to 20 hours), it is typical for $\tau_a$ to be carried out for so long as the absolute value of the rate of change of the reactor's pressure drop ABS[d(ΔP)/dt]

exceeds a predetermined value, e.g., ABS[d($\Delta P_a$)/dt]≥0.1 psi/hr (0.7 kPa/hr), such as ≥0.25 psi/hr (1.7 kPa/hr), or ≥0.5 psi/hr (3.5 kPa/hr), or ≥1 psi/hr (7 kPa/hr), or ≥5 psi/hr (35 kPa/hr). ABS[d($\Delta P_a$)/dt] represents ABS[d($\Delta P$)/dt] during $\tau_a$.

During a second regeneration time period $\tau_b$ following $\tau_a$, $T_{Reg}$ is increased from about $T_{Reg_a}$ to a predetermined temperature $T_{Reg_b}$. Typically, $T_{Reg_b}=T_{Reg_a}+Z$, where Z is ≥10° C., e.g., ≥25° C., such as ≥50° C., or ≥100° C., or ≥150° C. In certain aspects, Z is in the range of from 25° C. to 200° C., e.g., 50° C. to 150° C., such as 100° C. to 140° C. For example, $T_{Reg_b}$ can be in the range of from 300° C. to 500° C., such as in the range of from 325° C. to 425° C., or 350° C. to 400° C. The duration of $\tau_b$ is typically for a predetermined time, e.g., 1, 2, 3, 4, or 5 hours, e.g., in the range of from 1 to 20 hours. Typically, $\Delta P$ continues to decrease during $\tau_b$ although typically at a lesser rate than during $\tau_a$. In certain aspects, regeneration mode is concluded at the end of $\tau_b$, e.g., when (i) ABS[d($\Delta P_b$)/dt] is less than or equal to a predetermined value, such as ≤0.5 psi/hr (3.5 kPa/hr), or ≤0.25 psi/hr (1.7 kPa/hr), or ≤0.1 psi/hr (0.7 kPa/hr), or (ii) $\Delta P$ remains less than or equal to a predetermined value for a predetermined time, e.g., $\Delta P_b$ ≤2.5 psi (17 kPa) for at least one hour, such as ≤2 psi (14 kPa) for one hour, or ≤1.5 psi (10.3 kPa) for one hour. Typically, however, regeneration mode continues for additional periods $\tau_c$ and $\tau_d$.

During a third regeneration time period $\tau_c$ following $\tau_b$, $T_{Reg}$ is maintained substantially constant at a temperature $T_{Reg_c}$, with $T_{Reg_c}$ being substantially the same as $T_{Reg_b}$ at the end of $\tau_b$, such as $T_{Reg_b}$+/−10° C. Although the duration of $\tau_c$ can be for a predetermined time, e.g., 1, 2, 3, 4, or 5 hours (e.g., in the range of from 1 to 20 hours), it is typical for $\tau_c$ to be carried out for so long as (i) ABS[d($\Delta P$)/dt] exceeds a predetermined value, e.g., ABS[d($\Delta P_c$)/dt]≥0.1 psi/hr (0.7 kPa/hr), such as ≥0.25 psi/hr (1.7 kPa/hr), or ≥0.5 psi/hr (3.5 kPa/hr); or (ii) until $\Delta P$ remains less than or equal to a predetermined $\Delta P$ value for a predetermined time, e.g., $\Delta P_c$ ≤2.5 psi (17 kPa) for a time $t_c$, such as ≤2 psi (14 kPa) for a time $t_c$, or ≤1.5 psi (10.3 kPa) for a time $t_c$, or (iii) $\Delta P_c$ does not exceed G*$\Delta P_c$ for a time of at least $t_c$. Factor G is a positive number ≤0.8, e.g., in the range of from 0.05 to 0.8, such as from 0.1 to 0.7, or from 0.2 to 0.5; and $t_c$ is ≥0.1 hour, e.g., in the range of from 0.1 hour to 10 hours, such as 1 hour to 5 hours.

It has surprisingly been observed (see. e.g., FIG. 3) that $\Delta P$ does not always decrease at a substantially constant rate during $\tau_c$. While not wishing to be bound by any theory or model, it is believed that when operating the pretreatment reactor in pretreatment mode for a pretreatment rung length sufficient to cause $\Delta P_2$ to be at least twice $\Delta P_1$, a "crust" may form over at least part of the pretreatment reactor's catalyst bed. It is believed that the dramatic pressure drop exhibited during period $\tau_c$ in FIG. 3 results from at least partially removing the bed's crust. Accordingly, in certain aspects the third time period $\tau_c$ is not concluded until after $\Delta P$ has exhibited an abrupt decrease of ≥0.5 psi (3.5 kPa), e.g., ≥1 psi (7 kPa), such as ≥1.5 psi (10.3 kPa). The term "abrupt" in this context means ABS[d($\Delta P_c$)/dt] is ≥1 psi/hr (7 kPa/hr), e.g., ≥5 psi/hr (35 kPa/hr), such as ≥10 psi/hr (69 kPa/hr).

A fourth regeneration time period $\tau_d$ follows $\tau_c$. Typically, regeneration mode concludes at the end of $\tau_d$ (time $t_4$ occurs at the end of $\tau_d$), and the pretreatment reactor is switched to pretreatment mode. During $\tau_d$, $T_{Reg}$ is decreased, e.g., linearly over time, until a temperature $T_{PT}$ is achieved. In other words, $T_{Reg_d}$ at the end of $\tau_d$ is substantially the same $T_{PT}$ at the start of pretreatment mode. Although the duration of $\tau_d$ can be for a predetermined time, e.g., 1, 2, 3, 4, or 5 hours (e.g., in the range of from 1 to 20 hours), it is typical for $\tau_d$ to be carried out for so long as (i) ABS[d($\Delta P$)/dt] exceeds a predetermined value, e.g., ABS[d($\Delta P_d$)/dt]≥0.1 psi/hr (0.7 kPa/hr), such as ≥0.25 psi/hr (1.7 kPa/hr), or ≥0.5 psi/hr (3.5 kPa/hr); or (ii) until $\Delta P$ remains less than or equal to a predetermined $\Delta P$ value for a predetermined time, e.g., $\Delta P_d$ ≤2.5 psi (17.2 kPa) a time $t_C$, such as ≤2 psi (14 kPa) for a time $t_c$, or ≤1.5 psi (10.3 kPa) for a time $t_c$; or (iii) $\Delta P_d$ does not exceed H*$\Delta P_3$ for a time of at least $t_d$. Factor H is a positive number ≤0.8, e.g., in the range of from 0.05 to 0.8, such as from 0.1 to 0.7, or from 0.2 to 0.5; and $t_d$ is ≥0.1 hour, e.g., in the range of from 0.1 hour to 10 hours, such as 1 hour to 5 hours.

Intermediate Hydroprocessing of the Pretreated Tar-Fluid Mixture

In certain aspects not shown in FIG. 1, liquid and vapor portions are separated from the pretreater effluent. The vapor portion is upgraded to remove impurities such as sulfur compounds and light paraffinic hydrocarbon, and the upgraded vapor can be re-cycled as treat gas for use in one or more of hydroprocessing reactors 100, 400, and 500. The separated liquid portion can be conducted to a hydroprocessing stage operating under Intermediate Hydroprocessing Conditions to produce a hydroprocessed tar. Additional processing of the liquid portion, e.g., solids removal, can be used upstream of the intermediate hydroprocessing.

In other aspects, as shown in FIG. 1, the entire pretreater effluent is conducted away from reactor 400 via line 110 for intermediate hydroprocessing of the entire pretreater effluent in reactor 100. It will be appreciated by those skilled in the art, that for a wide range of conditions within the Pretreatment Hydroprocessing Conditions and for a wide range of tar-fluid mixtures, sufficient molecular hydrogen will remain in the pretreatment effluent for the intermediate hydroprocessing of the pretreated tar-fluid mixture in reactor 100.

As shown in FIG. 1, pretreater effluent in line 110 is conducted to reactor 100 for hydroprocessing under Intermediate Hydroprocessing Conditions. Typically, the intermediate hydroprocessing in at least one hydroprocessing zone of the intermediate reactor is carried out in the presence of a catalytically-effective amount of at least one catalyst having activity for hydrocarbon hydroprocessing. The catalyst can be selected from among the same catalysts specified for use in the pretreatment hydroprocessing. For example, the intermediate hydroprocessing can be carried out in the presence of a catalytically effective amount hydroprocessing catalyst(s) located in at least one catalyst bed 115. Additional catalyst beds, e.g., 116, 117, etc., may be connected in series with catalyst bed 115, optionally with intercooling using treat gas from conduit 60 being provided between beds (not shown). The hydroprocessed effluent is conducted away from reactor 100 via line 120.

The intermediate hydroprocessing is carried out in the presence of hydrogen, e.g., by one or more of (i) combining molecular hydrogen with the pretreatment effluent upstream of the intermediate hydroprocessing (not shown); (ii) conducting molecular hydrogen to the intermediate hydroprocessing in one or more conduits or lines (not shown); and (iii) utilizing molecular hydrogen (such as in the form of unreacted treat gas) in the pretreater effluent.

Typically, the Intermediate Hydroprocessing Conditions include $T_I$ >400° C., e.g., in the range of from 300° C. to 500° C., such as 350° C. to 430° C., or 350° C. to 420° C., or 360° C. to 420° C., or 360° C. to 410° C.; and a $WHSV_I$ in the range of from 0.3 $hr^{-1}$ to 20 $hr^{-1}$ or 0.3 $hr^{-1}$ to 10 $hr^{-1}$, based on the weight of the pretreated tar-fluid mixture subjected to the intermediate hydroprocessing. It is also typical for the Intermediate Hydroprocessing Conditions to include a molecular hydrogen partial pressure during the hydroprocessing ≥2.75 MPa, such as ≥3.5 MPa, e.g., ≥6 MPa, or ≥8 MPa, or ≥9 MPa, or ≥10 MPa, although in certain aspects it is ≤14 MPa, such as ≤13 MPa, or ≤12 MPa. $P_I$ is typically in the range of from 4 MPa to 15.2 MPa, e.g., 6 MPa to 13. 1 MPa. Generally, $WHSV_I$ is ≥0.5 $hr^{-1}$, such as ≥1.0 $hr^{-1}$, or alternatively ≤5 $hr^{-1}$, e.g., ≤4 $hr^{-1}$, or ≤3 $hr^{-1}$. Although the amount of molecular hydrogen supplied to a hydroprocessing stage operating under Intermediate Hydroprocessing Conditions is generally selected to achieve the desired molecular hydrogen partial pressure, it is typically in the range of from about 1000 SCF/B (standard cubic feet per barrel) (178 S $m^3/m^3$) to 10000 SCF/B (1780 S $m^3/m^3$), in which B refers to barrel of pretreated tar-fluid mixture that is conducted to the intermediate hydroprocessing. For example, the molecular hydrogen can be provided in a range of from 3000 SCF/B (534 S $m^3/m^3$) to 5000 SCF/B (890 S $m^3/m^3$). The amount of molecular hydrogen supplied to hydroprocess the pretreated pyrolysis tar component of the pretreated tar-fluid mixture is typically less than would be the case if the pyrolysis tar component was not pretreated and contained greater amounts of aliphatic olefin, e.g., $C_{6+}$ olefin, such as vinyl aromatics. The molecular hydrogen consumption rate during Intermediate Hydroprocessing Conditions is typically in the range of 350 standard cubic feet per barrel (SCF/B, which is about 62 standard cubic meters/cubic meter (S $m^3/m^3$)) to about 1500 SCF/B (267 S $m^3/m^3$), where the denominator represents barrels of the pretreated pyrolysis tar, e.g., in the range of about 1000 SCF/B (178 S $m^3/m^3$) to 1500 SCF/B (267 S $m^3/m^3$), or about 1600 SCF/B (285 S $m^3/m^3$) to 3200 SCF/B (570 S $m^3/m^3$).

Within the parameter ranges (T, P, WHSV, etc.) specified for Intermediate Hydroprocessing Conditions, particular hydroprocessing conditions for a particular pyrolysis tar are typically selected to (i) achieve the desired 566° C.+ conversion, typically ≥20 wt. % substantially continuously for at least ten days, and (ii) produce a TLP and hydroprocessed pyrolysis tar having the desired properties, e.g., the desired density and viscosity. The term 566° C.+ conversion means the conversion during hydroprocessing of pyrolysis tar compounds having boiling a normal boiling point ≥566° C. to compounds having boiling points <566° C. This 566° C.+ conversion includes a high rate of conversion of THs, resulting in a hydroprocessed pyrolysis tar having desirable properties.

The hydroprocessing can be carried out under Intermediate Hydroprocessing Conditions for a significantly longer duration without significant reactor fouling (e.g., as evidenced by no significant increase in hydroprocessing reactor pressure drop during the desired duration of hydroprocessing, such as a pressure drop of ≤140 kPa during a hydroprocessing duration of 10 days, typically ≤70 kPa, or ≤35 kPa) than is the case under substantially the same hydroprocessing conditions for a tar-fluid mixture that has not been pretreated. The duration of hydroprocessing without significantly fouling is typically least 10 times longer than would be the case for a tar-fluid mixture that has not been pretreated, e.g., ≥100 times longer, such as ≥1000 times longer.

Recovering the Hydroprocessed Pyrolysis Tar

Referring again to FIG. 1, the hydroprocessor effluent is conducted away from the intermediate hydroprocessing reactor 100 via line 120. When the second and third preheaters (360 and 70) are heat exchangers, the hot hydroprocessor effluent in conduit 120 can be used to preheat the tar/utility fluid and the treat gas respectively by indirect heat transfer. Following this optional heat exchange, the hydroprocessor effluent is conducted to separation stage 130 for separating total vapor product (e.g., heteroatom vapor, vapor-phase cracked products, unused treat gas, etc.) and total liquid product ("TLP") from the hydroprocessor effluent. The total vapor product is conducted via line 200 to upgrading stage 220, which typically comprises, e.g., one or more amine towers. Fresh amine is conducted to stage 220 via line 230, with rich amine conducted away via line 240. Regenerated treat gas is conducted away from stage 220 via line 250, compressed in compressor 260, and conducted via lines 265, 60, and 80 for re-cycle and re-use in the hydroprocessing stage 110.

The TLP from separation stage 130 typically comprises hydroprocessed pyrolysis tar, e.g., ≥10 wt. % of hydroprocessed pyrolysis tar, such as ≥50 wt. %, or ≥75 wt. %, or ≥90 wt. %. The TLP optionally contains non-tar components, e.g., hydrocarbon having a true boiling point range that is substantially the same as that of the utility fluid (e.g., unreacted utility fluid). The TLP is useful as a diluent (e.g., a flux) for heavy hydrocarbons, especially those of relatively high viscosity. Optionally, all or a portion of the TLP can substitute for more expensive, conventional diluents. Non-limiting examples of blendstocks suitable for blending with the TLP and/or hydroprocessed tar include one or more of bunker fuel; burner oil; heavy fuel oil, e.g., No. 5 and No. 6 fuel oil; high-sulfur fuel oil; low-sulfur fuel oil; regular-sulfur fuel oil (RSFO); gas oil as may be obtained from the distillation of crude oil, crude oil components, and hydrocarbon derived from crude oil (e.g., coker gas oil), and the like. For example, the TLP can be used as a blending component to produce a fuel oil composition comprising <0.5 wt. % sulfur. Although the TLP is an improved product over the pyrolysis tar feed, and is a useful blendstock "as-is", it is typically beneficial to carry out further processing.

In the aspects illustrated in FIG. 1, TLP from separation stage 130 is conducted via line 270 to a further separation stage 280, e.g., for separating from the TLP one or more of hydroprocessed pyrolysis tar, additional vapor, and at last one stream suitable for use as recycle as utility fluid or a utility fluid component. Separation stage 280 may be, for example, a distillation column with side-stream draw although other conventional separation methods may be utilized. An overhead stream, a side stream and a bottoms stream, listed in order of increasing boiling point, are separated from the TLP in stage 280. The overhead stream (e.g., vapor) is conducted away from separation stage 280 via line 290. Typically, the bottoms stream conducted away via line 134 comprises >50 wt. % of hydroprocessed pyrolysis tar, e.g., ≥75 wt. %, such as ≥90 wt. %, or ≥99 wt. %. At least a portion of the overhead and bottoms streams may be conducted away, e.g., for storage and/or for further processing. The bottoms stream of line 134 can be desirably used as a diluent (e.g., a flux) for heavy hydrocarbon, e.g., heavy fuel oil. When desired, at least a portion of the overhead stream 290 is combined with at least a portion of the bottoms stream 134 for a further improvement in properties.

Optionally, separation stage 280 is adjusted to shift the boiling point distribution of side stream 340 so that side stream 340 has properties desired for the utility fluid, e.g., (i) a true boiling point distribution having an initial boiling point ≥177° C. (350° F.) and a final boiling point ≤566° C. (1050° F.) and/or (ii) an $S_{BN}$ ≥100, e.g., ≥120, such as ≥125, or ≥130. Optionally, trim molecules may be separated, for example, in a fractionator (not shown), from separation stage 280 bottoms or overhead or both and added to the side stream 340 as desired. The side stream is conducted away from separation stage 280 via conduit 340. At least a portion of the side stream 340 can be utilized as utility fluid and conducted via pump 300 and conduit 310. Typically, the side stream composition of line 310 is at least 10 wt. % of the utility fluid, e.g., ≥25 wt. %, such as ≥50 wt. %.

The hydroprocessed pyrolysis tar has desirable properties, e.g., a 15° C. density measured that is typically at least 0.10 g/cm$^3$ less than the density of the thermally-treated pyrolysis tar. For example, the hydroprocessed tar can have a density that is at least 0.12, or at least 0.14, or at least 0.15, or at least 0.17 g/cm$^3$ less than the density of the pyrolysis tar composition. The hydroprocessed tar's 50° C. kinematic viscosity is typically ≤1000 cSt. For example, the viscosity can be ≤500 cSt, e.g., ≤150 cSt, such as ≤100 cSt, or ≤75 cSt, or ≤50 cSt, or ≤40 cSt, or ≤30 cSt. Generally, the intermediate hydroprocessing results in a significant viscosity improvement over the pyrolysis tar conducted to the thermal treatment, the pyrolysis tar composition, and the pretreated pyrolysis tar. For example, when the 50° C. kinematic viscosity of the pyrolysis tar (e.g., obtained as feed from a tar knock-out drum) is ≥1.0×10$^4$ cSt, e.g., ≥1.0×10$^5$ cSt, ≥1.0×10$^6$ cSt, or ≥1.0×10$^7$ cSt, the 50° C. kinematic viscosity of the hydroprocessed tar is typically ≤200 cSt, e.g., ≤150 cSt, such as ≤100 cSt, or ≤75 cSt, or ≤50 cSt, or ≤40 cSt, or ≤30 cSt. Particularly when the pyrolysis tar feed to the specified thermal treatment has a sulfur content ≥1 wt. %, the hydroprocessed tar typically has a sulfur content ≥0.5 wt. %, e.g., in a range of about 0.5 wt. % to about 0.8 wt. %.

When it is desired to further improve properties of the hydroprocessed tar, e.g., by removing at least a portion of any sulfur remaining in hydroprocessed tar, an upgraded tar can be produced by optional retreatment hydroprocessing. Certain forms of the retreatment hydroprocessing will now be described in more detail with respect to FIG. 1. The retreatment hydroprocessing is not limited to these forms, and this description is not meant to foreclose other forms of retreatment hydroprocessing within the broader scope of the invention.

Upgrading the Recovered Hydroprocessed Tar

Referring again to FIG. 1, hydroprocessed tar (line 134) and treat gas (line 61) are conducted to retreatment reactor 500 via line 510. Typically, the retreatment hydroprocessing in at least one hydroprocessing zone of the intermediate reactor is carried out in the presence of a catalytically-effective amount of at least one catalyst having activity for hydrocarbon hydroprocessing. For example, the retreatment hydroprocessing can be carried out in the presence hydroprocessing catalyst(s) located in at least one catalyst bed 515. Additional catalyst beds, e.g., 516, 517, etc., may be connected in series with catalyst bed 515, optionally with intercooling using treat gas from conduit 61 being provided between beds (not shown). The catalyst can be selected from among the same catalysts specified for use in the pretreatment hydroprocessing. A retreater effluent comprising upgraded tar is conducted away from reactor 500 via line 135.

Although the retreatment hydroprocessing can be carried out in the presence of the utility fluid, it is typical that it be carried out with little or no utility fluid to avoid undesirable utility fluid hydrogenation and cracking under Retreatment Hydroprocessing Conditions, which are generally more severe than the Intermediate Hydroprocessing Conditions. For example, (i) ≥50 wt. % of liquid-phase hydrocarbon present during the retreatment hydroprocessing is hydroprocessed tar obtained from line 134, such as ≥75 wt. %, or ≥90 wt. %, or ≥99 wt. % and (ii) utility fluid comprises ≤50 wt. % of the balance of the of liquid-phase hydrocarbon, e.g., ≤25 wt. %, such as ≤10 wt. %, or ≤1 wt. %. In certain aspects, the liquid phase hydrocarbon present in the retreatment reactor is a hydroprocessed tar that is substantially-free of utility fluid.

The Retreatment Hydroprocessing Conditions typically include $T_R$ ≥370° C.; e.g., in the range of from 370° C. to 415° C.; $WHSV_R$ ≤0.5 hr$^{-1}$, e.g., in the range of from 0.2 hr$^{-1}$ to 0.5 hr$^{-1}$; a molecular hydrogen supply rate ≥3000 SCF/B, e.g., in the range of from 3000 SCF/B (534 S m$^3$/m$^3$) to 6000 SCF/B (1068 S m$^3$/m$^3$); and a total pressure ("$P_R$") ≥6 MPa, e.g., in the range of from 6 MPa to 13.1 MPa. Optionally, $T_R$>$T_I$ and/or $WHSV_R$<$WHSV_I$.

The upgraded tar typically has a sulfur content ≤0.3 wt. %, e.g., ≤0.2 wt. %. Other properties of the upgraded tar include a hydrogen: carbon molar ratio ≥1.0, e.g., ≥1.05, such as ≥1.10, or ≥1.055; an $S_{BN}$ ≥185, such as ≥190, or ≥195; an $I_N$ ≤105, e.g., ≤100, such as ≤95; a 15° C. density ≤1.1 g/cm$^3$, e.g., ≤1.09 g/cm$^3$, such as ≤1.08 g/cm$^3$, or ≤1.07 g/cm$^3$; a flash point ≥, or ≤−35° C. Generally, the upgraded tar has 50° C. kinematic viscosity that is less than that of the hydroprocessed tar, and is typically ≤1000 cSt, e.g., ≤900 cSt, such as ≤800 cSt. The retreating generally results in a significant improvement in one or more of viscosity, solvent blend number, insolubility number, and density over that of the hydroprocessed tar fed to the retreater. Desirably, since the retreating can be carried out without utility fluid, these benefits can be obtained without utility fluid hydrogenation or cracking.

The upgraded tar can be blended with one or more blendstocks, e.g., to produce a lubricant or fuel, e.g., a transportation fuel. Suitable blendstocks include those specified for blending with the TLP and/or hydroprocessed tar.

EXAMPLE

A representative pyrolysis tar is subjected to the specified thermal treatment and is combined with the specified utility fluid (60 vol. % tar: 40 vol. % utility fluid) to produce a tar-fluid mixture. Selected properties of the thermally-treated pyrolysis tar are shown in Table 2.

TABLE 2

| Property | Thermally-Treated Pyrolysis Tar |
|---|---|
| Density | 1.18 |
| Hydrogen Content (Wt. %) | 6.1 |
| Sulfur Content (Wt. %) | 4.4 |
| Aromatic Carbon Content (wt. %) | 84.9 |
| Olefin Content (wt. %) | 0 |
| Asphaltene Content (Wt. %) | 47.2 |

Figure 2:
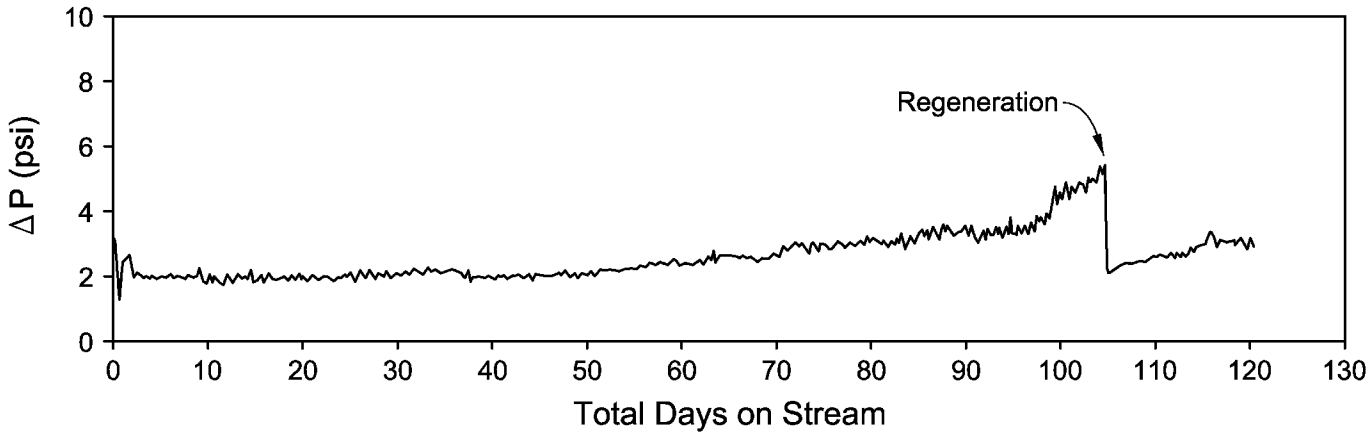
FIG. 2 is a graph of pretreatment reactor pressure drops ΔP (in psi) versus days on stream during pretreatment mode (before about day 105), regeneration mode (about day 105), and continued pretreatment mode (days 106-120).

The thermally-treated tar is subjected to pretreatment hydroprocessing during pretreatment mode operation commencing at time $t_1$. The Pretreatment Hydroprocessing Conditions at $t_1$ include $P_{PT}$=1200 psi (8.2 MPa), $T_{PT}$=270° C., a pyrolysis tar space velocity ($WHSV_{PT}$)=1.5 h$^{-1}$, and a molecular hydrogen space velocity (GHSV)=188 hr$^{-1}$. Over a pretreatment time of 105 days ($t_2$), the pretreatment reactor pressure drop increases from an initial value $\Delta P_1$ of about 2 psi (14 kPa) to achieve a $\Delta P_2$ of about 5 psi (34 kPa), as shown in FIG. 2. After achieving a $\Delta P_2$ of about 5 psi (34 kPa), the flow of thermally-treated pyrolysis tar feed is halted and the pretreatment reactor is switched from pretreatment mode to regeneration mode. At the start of regeneration mode (at time $t_3$), molecular hydrogen low to the reactor is maintained substantially unchanged from its value during pretreatment mode, and the temperature of the reactor's catalyst bed is substantially marinated at a temperature $T_{PT}$. The reactor's total pressure is substantially the same as the total pressure utilized during pretreatment mode. The reactor's pressure drop ΔP rapidly decreases at $t_3$ from $\Delta P_2$ of 5 psi (34 kPa) to about 2 psi (14 kPa), as is expected since the flow of pyrolysis tar feed is halted at $t_3$.

After operating regeneration mode for about four hours from $t_3$ under these conditions, the reactor is substantially purged of liquid hydrocarbon, and $T_{Reg}$ is gradually increased to about 375° C. as shown in FIG. 3 (upper curve and right-hand axis). FIG. 3 also shows that $T_{Reg}$ is maintained substantially constant at about 375° C. until about 21 hours from $t_3$, and is then gradually decreased until an average temperature of about $T_{PT}$ is achieved. After maintaining the average temperature at about $T_{PT}$, for about 2 hours (until about 27 hours after the start of regeneration mode=time $t_4$), the reactor is switched back to pretreatment mode.

FIG. 2 shows that the regeneration restores the pretreatment reactor's pressure drop ΔP to a value that is substantially the same as $\Delta P_1$. FIG. 3 (lower curve and left-hand axis) shows in more detail the decrease in pretreatment reactor ΔP during regeneration mode. As shown, ΔP rapidly decreases from $\Delta P_3$ to about 0.8 psi (5.5 kPa) over about one hour after $t_3$. Afterward, ΔP continues to decrease, but more gradually, until about 15 hours from $t_3$. The abrupt decrease in ΔP occurring at about 15 hours after $t_3$ is not well understood, but is believed to result from breakthrough of a "crust" layer of foulant deposited on or proximate to the catalyst bed. FIG. 3 also shows that no appreciable decrease in reactor ΔP is achieved after about 25 hours of regeneration mode, which indicated that the reactor is in condition for switching to pretreatment mode at time $t_4$.

All patents, test procedures, and other documents cited herein, including priority documents, are fully incorporated by reference to the extent such disclosure is not inconsistent and for all jurisdictions in which such incorporation is permitted.

While the illustrative forms disclosed herein have been described with particularity, it will be understood that various other modifications will be apparent to and can be readily made by those skilled in the art without departing from the spirit and scope of the disclosure. Accordingly, it is not intended that the scope of the claims appended hereto be limited to the example and descriptions set forth herein, but rather that the claims be construed as encompassing all the features of patentable novelty which reside herein, including all features which would be treated as equivalents thereof by those skilled in the art to which this disclosure pertains.

When numerical lower limits and numerical upper limits are listed herein, ranges from any lower limit to any upper limit are contemplated.

The invention claimed is:

1. A pyrolysis tar pretreatment process, comprising:

(a) providing a pyrolysis tar having a reactivity ($R_T$)>28 BN, wherein, at least 70 wt. % of the pyrolysis tar's components have a normal boiling point of at least 290° C., based on the total weight of the pyrolysis tar;

(b) maintaining the pyrolysis tar within a temperature range of from $T_1$ to $T_2$ for a time ($t_{HS}$) sufficient to produce a pyrolysis tar composition having a reactivity $R_C<R_T$ and an insolubles content $I_C\leq 6$ wt. %, wherein, $T_1$ is ≥150° C., $T_2$ is ≤320° C., and $t_{HS}$ is ≥1 minute;

(c) combining the pyrolysis tar composition with a utility fluid comprising hydrocarbon to produce a tar-fluid mixture having a reactivity $R_M \leq 18$ BN;

(d) during a time period of from $t_1$ to $t_2$, hydroprocessing during a pretreatment mode at least a portion of the tar-fluid mixture in the presence of molecular hydrogen within a pretreatment reactor to produce a pretreater effluent comprising a vapor portion and a liquid portion, wherein:

(i) the liquid portion comprises a pretreated tar-fluid mixture which includes a pretreated pyrolysis tar, (ii) the pretreated tar-fluid mixture has a reactivity ($R_F$) ≤12 BN, and (iii) the hydroprocessing is carried out under Pretreatment Hydroprocessing Conditions which include a pressure drop $\Delta P=\Delta P_1$ at $t_1$, a temperature $T_{PT}\leq 400°$ C., a space velocity ($WHSV_{PT}$) ≥0.3 $hr^{-1}$ based on the weight of the hydroprocessed portion of the tar-fluid mixture, a total pressure ($P_{PT}$) ≥8 MPa, and supplying the molecular hydrogen at a rate <3000 standard cubic feet per barrel of the hydroprocessed portion of the tar-fluid mixture (SCF/B), and (e) switching the pretreatment reactor from the pretreatment mode to a regeneration mode carried out after $t_2$ for a time period of from $t_3$ to $t_4$, and during regeneration mode regenerating the pretreatment reactor under regeneration conditions which include a pressure drop $\Delta P_3$ at $t_3$, a temperature $T_{Reg}\geq T_{PT}$, a total pressure $P_{Reg}$ ≥3.5 MPa, and a molecular hydrogen $GHSV_{Reg}$ in the range of from 75 $hr^{-1}$ to 750 $hr^{-1}$.

2. The process of claim 1, wherein (i) $t_2$ corresponds to the time at which the pretreatment reactor achieves a pressure drop $\Delta P_2$ that is the lesser of (I) F *$\Delta P_1$, with F being in the range of from 1.5 to 20, or (II) a threshold ΔP≥2 psi; and (ii) $t_4$ corresponds to the time at which the pretreatment reactor achieves a pressure drop $\Delta P_4\leq 0.5*\Delta P_3$.

3. The process of claim 1, wherein $P_{Reg}$ is $\leq P_{PT}$ and $GHSV_{Reg}$ is in the range of from 211 $hr^{-1}$ to 600 $hr^{-1}$.

4. The process of claim 1, wherein (i) $T_{Reg}$ is in the range of from 325° C. to 425° C. during at least part of the regeneration, and (ii) during the part of the regeneration where $T_{Reg}$ is in the range of from 325° C. to 425° C., ΔP exhibits a decrease of ≥0.5 psi, during which decrease ABS[d(ΔP)/dt] is ≥1 psi/hr.

5. The process of claim 1, wherein $R_T$ is in the range of from 29 BN to 45 BN, ≥90 wt. % of the pyrolysis tar has a normal boiling point ≥290° C., and wherein the pyrolysis tar has an Insolubles Content ($IC_T$) ≤6 wt. %, an $I_N\geq 80$, a 15° C. kinematic viscosity ≥600 cSt, and a 15° C. density ($\rho_T$) ≥1.1 g/$cm^3$.

6. The process of claim 1, wherein the pyrolysis tar is a steam cracker tar having one or more of (i) a TH content in the range of from 5.0 wt. % to 40.0 wt. %; (ii) an API gravity (measured at a temperature of 15.8° C.) of ≤8.5° API; (iii) a 50° C. viscosity in the range of $1\times 10^3$ cSt to $1.0\times 10^7$ cSt; and (iv) a sulfur content that is >0.5 wt. %.

7. The process of claim 1, wherein $t_{HS}$ is in the range from 10 minutes to 400 minutes, $R_C\leq 28$ BN, and $R_C$ is $\leq R_T$-4BN.

8. The process of claim 1, wherein the tar-fluid mixture has 50° C. kinematic viscosity that is ≤500 cSt, and 12 BN≤$R_M$ ≤18 BN.

9. The process of claim 1, wherein $t_{HS}$ is in the range of from 30 minutes to 400 minutes, $R_C$ is $\leq R_T$−8 BN, and $R_F\leq 11$ BN.

10. The process of claim 1, wherein $T_1 \geq 180°$ C., $T_2 \leq 300°$ C., $t_{HS}$ is in the range of from 5 minutes to 100 minutes, and $R_C$ is $\leq R_I 0.5$ BN.

11. The process of claim 1, wherein the utility fluid comprises aromatic hydrocarbon and has a 10% distillation point ≥60° C. and a 90% distillation point ≤425° C.

12. The process of claim 1, wherein the tar-fluid mixture comprises 50 wt. % to 70 wt. % of pyrolysis tar, with ≥90 wt. % of the balance of the tar-fluid mixture comprising the utility fluid.

13. The process of claim 1, wherein (i) $T_{PT}$ is in the range of from 220° C. to 300° C., $WHSV_{PT}$ is in the range of from 1.5 $hr^{-1}$to 3.5 $hr^{-1}$, and the molecular hydrogen supply rate is in a range of about 300 SCF/B to 1000 SCF/B, and $P_{PT}$ is in the range of from 6 MPa to 13.1 MPa; and (ii) the Pretreatment Hydroprocessing Conditions further include a molecular hydrogen consumption rate in the range of from 100 standard cubic feet per barrel of the pyrolysis tar composition in the tar-fluid mixture (SCF/B) to 600 SCF/B.

14. The process of claim 1, further comprising:

(f) hydroproces sing in the presence of molecular hydrogen at least a portion of the pretreater effluent under Intermediate Hydroproces sing Conditions to produce a hydroprocessor effluent comprising hydroprocessed pyrolysis tar, wherein:

(i) the Intermediate Hydroprocessing Conditions include a temperature ($T_1$) ≥200° C., total pressure ($P_I$) ≥8 MPa, a space velocity ($WHSV_I$) ≥0.3 $hr^{-1}$ based on the weight of the liquid portion of the pretreater effluent hydroprocessed in (e), and a molecular hydrogen supply rate ≥3000 standard cubic feet of the pretreated tar hydroprocessed in (e) (SCF/B), and (ii) $WHSV_I < WHSV_{PT}$.

15. The process of claim 14, wherein (i) $T_I$ is in the range of from 360° C. to 410° C., $T_I > T_{PT}$, $WHSV_I$ is in the range of from 0.5 $hr^{-1}$ to 1.2 $hr^{-1}$, the molecular hydrogen supply rate is in the range of from 3000 SCF/B to 5000 SCF/B, and $P_I$ is in the range of from 6 MPa to 13.1 MPa; and (ii) the Intermediate Hydroprocessing Conditions further include a molecular hydrogen consumption rate in the range of from 1600 standard cubic feet per barrel of tar in the pretreater effluent (SCF/B) to 3200 SCF/B.

16. The process of claims 14, wherein the hydroprocessing of step (f) is carried out in a second reactor, and the second reactor exhibits a 566° C.+conversion of at least 20 wt. % substantially continuously for at least thirty days.

17. The process of claim 14, further comprising separating from the hydroprocessed effluent (i) a primarily vapor-phase first stream comprising at least a portion of any unreacted molecular hydrogen; (ii) a primarily liquid-phase second stream comprising at least a portion of the hydroprocessed pyrolysis tar, and (iii) a primarily liquid-phase third stream comprising at least a portion of any unreacted utility fluid;

recycling to the hydroproces sing of steps (d) and/or (e) at least a portion of the first stream, and recycling at least a portion of the third stream to step (c).

18. The process of claim 17, wherein the second stream comprises ≥1 wt. % of sulfur and ≤10 wt. % of hydrocarbon having a 10% distillation point ≥60° C. and a 90% distillation point ≤425° C., and wherein the process further comprises hydroprocessing the second stream under Retreatment Hydroprocessing Conditions in the presence of molecular hydrogen to produce an upgraded tar comprising ≤0.5 wt. % sulfur, and the Retreatment Hydroprocessing Conditions include a temperature ($T_R$) in the range of from 370° C. to 415° C., a space velocity ($WHSV_R$) is in the range of from 0.2 $hr^{-1}$ to 0.5 $hr^{-1}$, a molecular hydrogen supply rate in the range of from 3000 SCF/B to 5000 SCF/B, a total pressure in the range of from 6 MPa to 13.1 MPa, and $WHSV_R < WHSV_I$.

19. The process of claim 1, further comprising removing at least a portion of the insolubles at a temperature in the range of from 80° C. to 100° C. using a centrifuge.

* * * * *